US010118778B2

(12) United States Patent
Kawashima

(10) Patent No.: US 10,118,778 B2
(45) Date of Patent: Nov. 6, 2018

(54) SHEET STACKING APPARATUS, SHEET CONVEYING APPARATUS, AND IMAGE FORMING APPARATUS

(71) Applicant: CANON KABUSHIKI KAISHA, Tokyo (JP)

(72) Inventor: Tomomichi Kawashima, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/590,212

(22) Filed: May 9, 2017

(65) Prior Publication Data

US 2017/0327327 A1 Nov. 16, 2017

(30) Foreign Application Priority Data

May 13, 2016 (JP) ..... 2016-097231

(51) Int. Cl.

| | |
|---|---|
| ***B65H 1/14*** | (2006.01) |
| ***B65H 1/18*** | (2006.01) |
| ***B65H 1/08*** | (2006.01) |
| ***B65H 7/00*** | (2006.01) |
| ***B65H 31/34*** | (2006.01) |
| ***B65H 3/06*** | (2006.01) |

(52) U.S. Cl.

CPC ..... *B65H 1/18* (2013.01); *B65H 1/08* (2013.01); *B65H 1/14* (2013.01); *B65H 3/0684* (2013.01); *B65H 7/00* (2013.01); *B65H 31/34* (2013.01); *B65H 2403/42* (2013.01); *B65H 2403/47* (2013.01); *B65H 2403/481* (2013.01); *B65H 2403/512* (2013.01); *B65H 2403/72* (2013.01); *B65H 2801/06* (2013.01)

(58) Field of Classification Search

CPC ..... B65H 1/14; B65H 1/18; B65H 1/08

See application file for complete search history.

(56) References Cited

U.S. PATENT DOCUMENTS

| | | | | |
|---|---|---|---|---|
| 8,276,906 | B2 | 10/2012 | Yamamoto | |
| 8,540,234 | B2 | 9/2013 | Akatsuka et al. | |
| 8,602,409 | B2 * | 12/2013 | Sekiguchi | B65H 1/14 271/147 |
| 8,888,092 | B2 * | 11/2014 | Hayayumi | B65H 1/025 271/127 |
| 9,764,911 | B2 * | 9/2017 | Toso | B65H 1/14 |
| 2011/0180985 | A1 | 7/2011 | Yamamoto | |
| 2013/0134656 | A1 | 5/2013 | Akatsuka et al. | |

FOREIGN PATENT DOCUMENTS

| | | | |
|---|---|---|---|
| JP | 11-322090 | A | 11/1999 |
| JP | 2011-153014 | A | 8/2011 |
| JP | 2013-107773 | A | 6/2013 |

* cited by examiner

*Primary Examiner* — Luis A Gonzalez

(74) *Attorney, Agent, or Firm* — Fitzpatrick, Cella, Harper & Scinto

(57) ABSTRACT

A driven gear is relatively movable to a first support position and to a second support position on a support member. When a first gear rotates in a first direction, the driven gear rotates at the first support position in conjunction with rotation of the first gear to permit the rotation of the driven gear. When the first gear rotates in a second direction opposite to the first direction, the driven gear moves to the second support position under a force received from the gear in an area where the driven gear meshes with the first gear. Then, at the second support position, the driven gear is locked on a locking member and thus stopped, preventing the first gear from rotating in the second direction.

10 Claims, 22 Drawing Sheets

SHEET STACKING APPARATUS, SHEET CONVEYING APPARATUS, AND IMAGE FORMING APPARATUS

BACKGROUND OF THE INVENTION

Field of the Invention

The present invention relates to a sheet stacking apparatus, a sheet conveying apparatus, and an electrophotographic image forming apparatus, such as a copier or a printer, which includes the sheet conveying apparatus.

Description of the Related Art

Some image forming apparatuses form images on sheet materials using an electrophotographic system. Examples of such image forming apparatuses include electrophotographic copiers and electrophotographic printers. Such an image forming apparatus is provided with a sheet conveying apparatus that conveys sheet materials one by one which are stacked on a sheet stacking plate.

For example, in the invention described in Japanese Patent Application Laid-open No. 2011-153014, a pickup roller is arranged above the sheet stacking plate, and an elevating member is displaced so as to elevate the sheet stacking plate according to a decrease in the number of sheets remaining on the sheet stacking plate. This prevents a significant decrease in contact pressure between the pickup roller and the sheet materials remaining on the sheet stacking plate.

A switching member such as an arm is swung with respect to a trigger member to switch a case where a force that displaces the elevating member is transmitted to the elevating member side so as to elevate the sheet stacking plate and a case where the transmission of the force is interrupted. In this case, the elevating member is prevented from being displaced downward while the transmission of the force is interrupted, by using a well-known ratchet mechanism including a ratchet gear and a pallet member.

However, when, with the ratchet gear meshed with the pallet member, the force is transmitted to the elevating member side to displace the elevating member upward, the ratchet gear rotates in conjunction with the upward displacement of the elevating member. Consequently, toothing of the ratchet gear and the pallet member repeatedly collide against each other to generate noise.

Thus, the following configuration is proposed in the invention described in Japanese Patent Application Laid-open No. 2013-107773. When a force displaces the elevating member so as to elevate the elevating member, a swinging member including an elastic member that presses the pallet member against the ratchet gear swings to a position where the pallet member is inhibited from being subjected to an elastic force. This inhibits application of the force that presses the pallet member against the ratchet gear, allowing the pallet member to be freely displaced with respect to the swinging member.

SUMMARY OF THE INVENTION

A drive elevation state as used herein refers to a state where a switching member swings with respect to a trigger member to transmit a force that displaces an elevating member so as to elevate a sheet stacking plate. A stoppage hold state as used herein refers to a state where the transmission of the force is interrupted.

If the ratchet gear and the pallet member, meshed with each other, are driven upward, when the ratchet gear rotates by an amount larger than the distance between teeth of the ratchet gear, the pallet member collides against toothing of the ratchet gear to generate noise. When the ratchet gear further continues to rotate, the pallet member repeatedly collides against the toothing of the ratchet gear and retracts, leading to intermittent noise. Consequently, in order to prevent noise, increasing the distance between the teeth of the ratchet gear and thus a spacewidth is desirable.

On the other hand, in the stoppage holding state, backward rotation of the ratchet gear needs to be immediately stopped to minimize the distance that the sheet stacking plate lowers. Consequently, in order to prevent the sheet stacking plate from lowering, reducing the distance between the teeth of the ratchet gear and thus the spacewidth is desirable.

Thus, a separation timing when the pallet member separates from the ratchet gear needs to be controlled such that the switching member swings with respect to the trigger member to allow switching to the drive elevation state and that the separation occurs simultaneously with the switching to the drive elevation state. An engagement timing when the pallet member comes into engagement with the ratchet gear needs to be controlled such that the switching member swings with respect to the trigger member to allow switching to the stoppage holding state and that the engagement occurs simultaneously with the switching to the stoppage holding state.

In the inventions in Japanese Patent Application Laid-open Nos. 2011-153014 and 2013-107773, the separation timing and the engagement timing for the pallet member with respect to the ratchet gear are determined based on the dimensions of related components. Specifically, the timings are determined based on the dimensions of the trigger member, the switching member, the pallet member, the ratchet gear, and a cam member. However, in actuality, consideration for variations in dimensions precludes the separation and the engagement from being performed at the same timing as that for the swinging operation of the switching member with respect to the trigger member.

Consequently, when the stoppage holding state is shifted to the drive elevation state, the sequence of control is such that after the switching member is brought into engagement with the trigger member, the pallet member is separated from the ratchet gear. When the drive elevation state is shifted to the stoppage holding state, the pallet member is brought into engagement with the ratchet gear with the switching member remaining engaged with the trigger member. In the sequence of control, the switching member is subsequently separated from the trigger member. A cam profile of the cam member is formed in accordance with the above-described sequence of control.

Therefore, there are not a few cases where the ratchet gear rotates while being meshed with the pallet member, thus it is not possible to preclude generation of a sound of collision between the toothings of the ratchet gear and the pallet member.

An object of the present invention is to provide a sheet stacking apparatus, a sheet conveying apparatus, and an image forming apparatus that are configured to enable possible noise to be prevented, while eliminating the need for complicated control of a separation timing and an engagement timing to allow for a reduction in the size of the sheet stacking apparatus and in manufacturing costs.

In order to attain an object of the present invention, a sheet stacking apparatus according to the present invention is characterized including, a stacking plate on which a sheet material is stacked;

an elevating member that elevates the stacking plate;

a first rotating member that transmits, when rotating in a first direction, a force of elevating the stacking plate to the stacking plate;

a second rotating member that meshes with the first rotating member and rotates in conjunction with rotation of the first rotating member;

a support member that supports the second rotating member such that the second rotating member can move; and a locking member on which the second rotating member is enabled to be locked so as to stop rotation of the second rotating member, wherein the second rotating member is movable to a first support position and to a second support position on the support member, when the first rotating member rotates in a first direction, the second rotating member rotates at the first support position in conjunction with rotation of the first rotating member to permit the rotation of the first rotating member, when the first rotating member rotates in a second direction opposite to the first direction, the second rotating member moves to the second support position under a force received from the first rotating member in an area where the second rotating member meshes with the first rotating member, and at the second support position, the second rotating member is locked on the locking member, and the locked second rotating member prevents the first rotating member from rotating in the second direction.

As described above, the present invention provides the sheet stacking apparatus that enables possible noise to be prevented while allowing for a reduction in the size of the apparatus and in costs.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Embodiment 1

Figure 1:
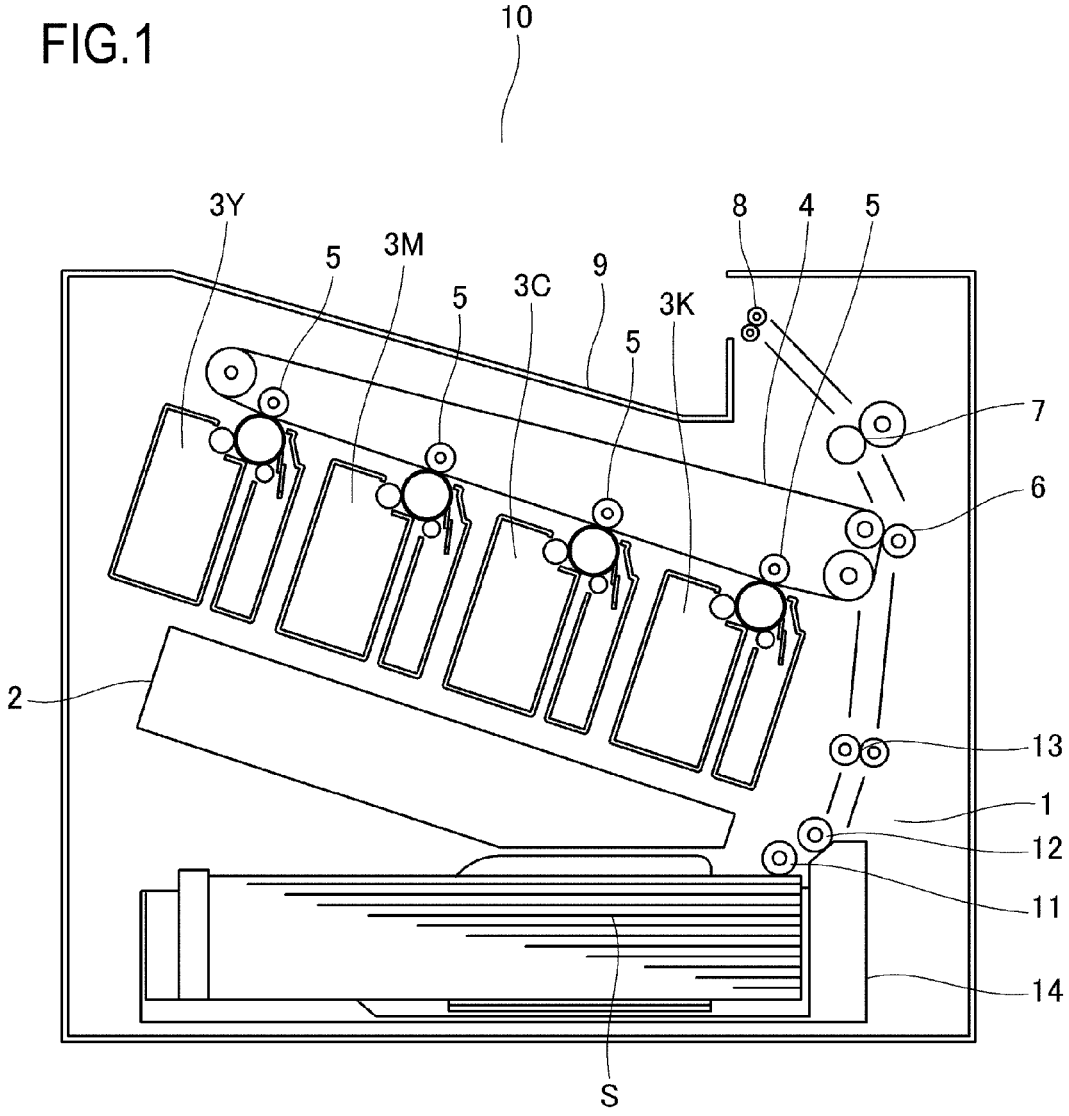
FIG. 1 is a sectional view of an important part of an image forming apparatus according to an embodiment of the present invention.
Figure 2:
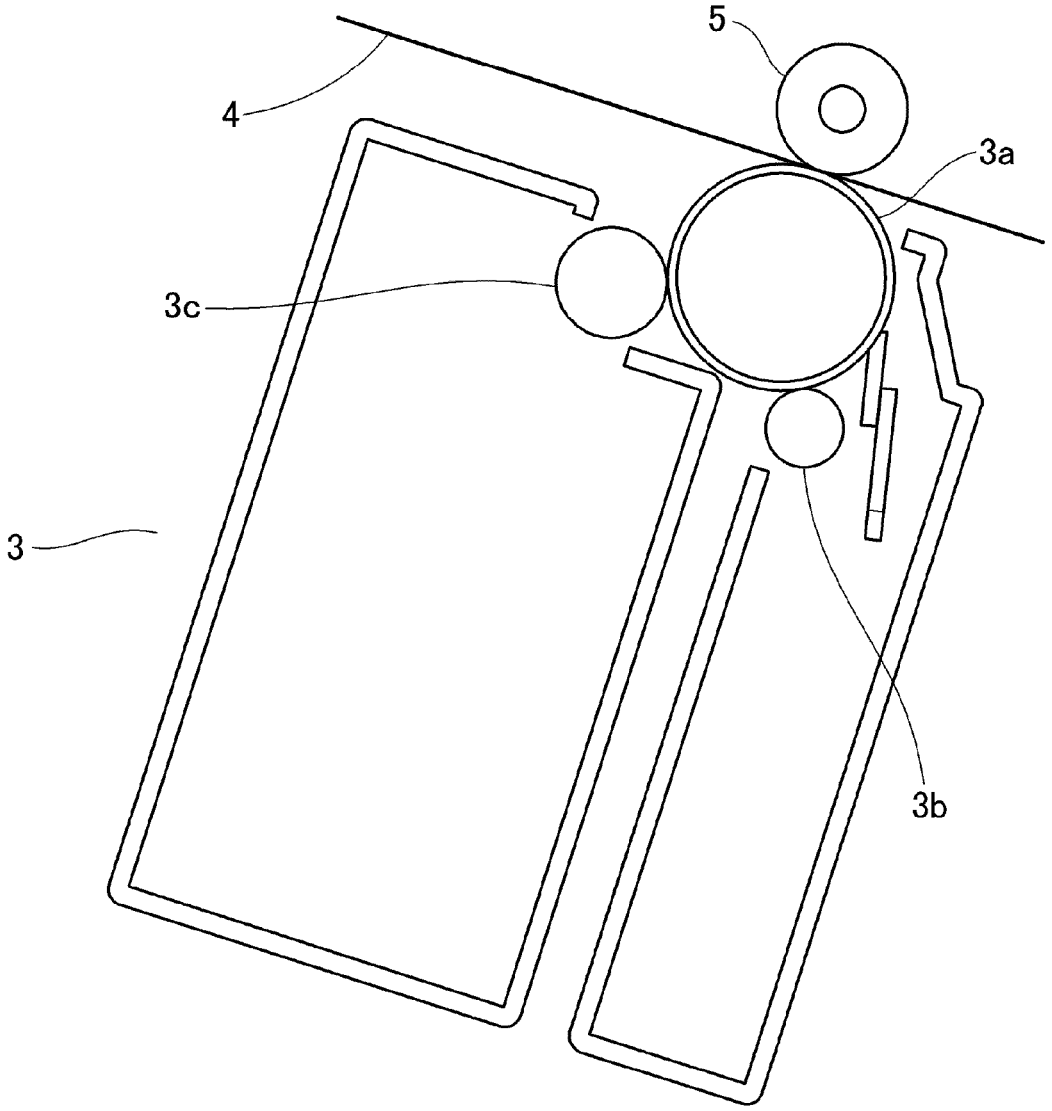
FIG. 2 is a sectional view of an important part of a process cartridge according to the embodiment of the present invention.

Embodiment 1 of the present invention will be described based on the drawings. FIG. 1 is a sectional view schematically depicting a configuration of an image forming apparatus in an embodiment of the present invention. FIG. 2 is a sectional view schematically depicting a configuration of a process cartridge in the present embodiment.

An image forming apparatus 10 uses a well-known electrophotographic technique to form a toner image based on externally input image information and to transfer and fix the image to media such as paper. Examples of the image forming apparatus 10 include copiers, laser beam printers, and facsimile machines. In the present embodiment, a color laser beam printer will be described as an example of the image forming apparatus. A process cartridge 3 refers to a cartridge that can be installed in and removed from an image forming apparatus main body and that integrally includes at least development means 3*c* and an electrophotographic image carrier (photosensitive drum) 3*a* serving as process means.

General Configuration of the Image Forming Apparatus

First, a general configuration of the image forming apparatus 10 will be described with reference to FIG. 1 and FIG. 2. The general configuration of the image forming apparatus 10 is common to Embodiment 1 and Embodiment 2 described below.

The image forming apparatus 10 chiefly includes a sheet conveying apparatus 1, exposure means 2, the process cartridge 3, an intermediate transfer belt 4, primary transfer means 5, secondary transfer means 6, and fixing means 7. The process cartridge 3 chiefly includes a photosensitive drum 3*a*, a charger 3*b*, and the development means 3*c*. An image forming unit of the present invention corresponds to a set of the exposure means 2, the process cartridge 3, the intermediate transfer belt 4, the primary transfer means 5, the secondary transfer means 6, and the fixing means 7.

The charger 3*b* charges a surface of the photosensitive drum 3*a* and the exposure means 2 exposes the photosensitive drum 3*a* in accordance with an image signal, thus forming an electrostatic latent image on the surface of the photosensitive drum 3*a*. The electrostatic latent image is developed by the development means 3*c* to form a toner image. The toner image is transferred by the primary transfer means 5 to a surface of the intermediate transfer belt 4 carrying the toner image.

FIG. 1 is a tandem image forming apparatus including four process cartridges 3Y, 3M, 3C, 3K arranged in line. The four process cartridges 3Y, 3M, 3C, 3K have an identical structure. The process cartridges correspond to four colors, yellow (hereinafter referred to as Y), magenta (hereinafter referred to as M), cyan (hereinafter referred to as C), and black (hereinafter referred to as K), respectively. On the intermediate transfer belt 4 being rotated, toner images in the respective colors are laid on top of one another to form a color image.

Sheet materials S such as paper set in the sheet conveying apparatus 1 are each fed by a pickup roller (conveying means) 11 and a feed roller 12 and transferred to the secondary transfer means 6 while being sandwiched between paired registration rollers 13. The toner image formed on the intermediate transfer belt 4 is transferred to the sheet material S by the secondary transfer means 6 and then fed to the fixing means 7. In the fixing means 7, the toner image is fixed on the sheet material S by heat and pressure. Subsequently, the sheet material S is conveyed by paired discharge rollers 8 and discharged and loaded onto a discharge tray 9 provided in an upper portion of the image forming apparatus.

Configuration of the Sheet Conveying Apparatus

Figure 3:
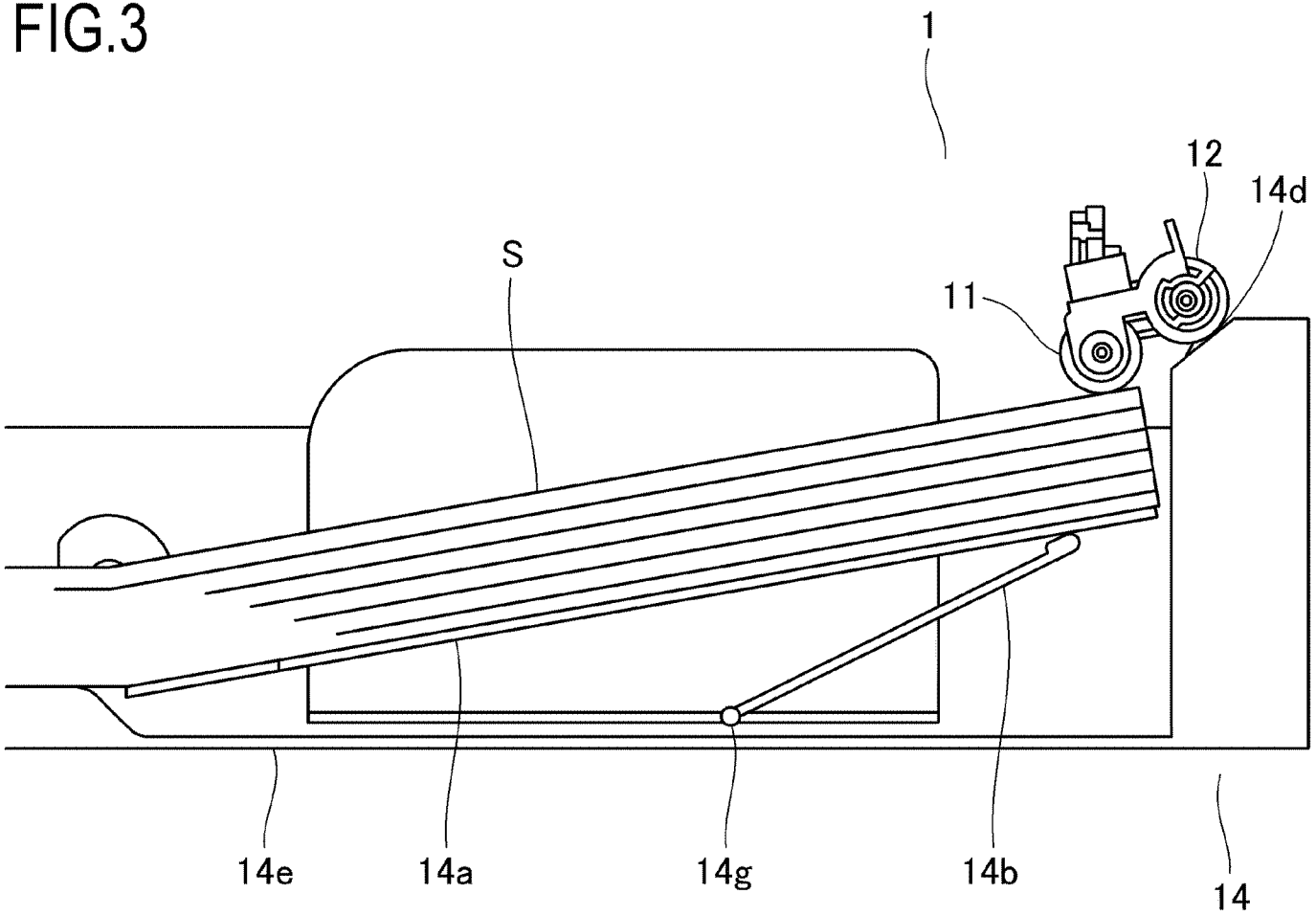
FIG. 3 is a sectional view of an important part of a sheet conveying apparatus according to the embodiment of the present invention.
Figure 4:
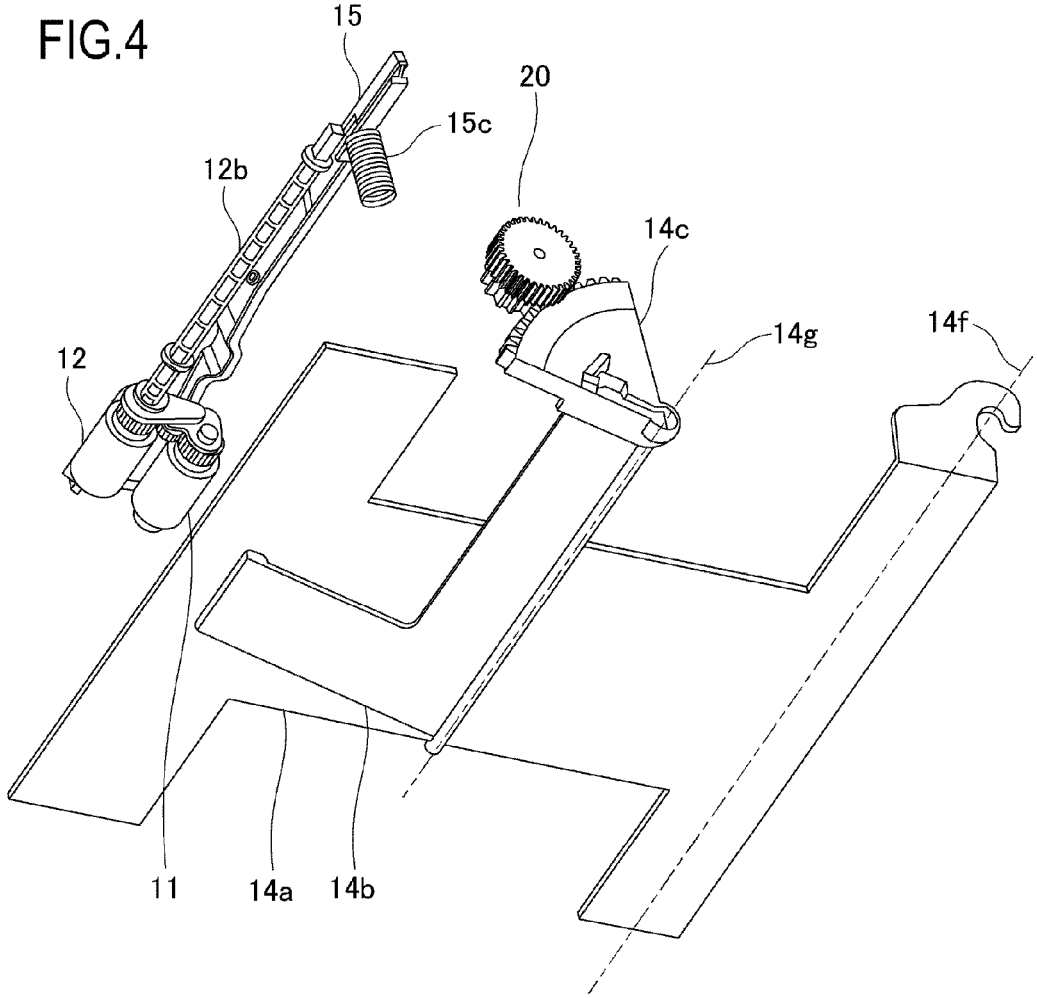
FIG. 4 is a perspective view of the important part of the sheet conveying apparatus according to the embodiment of the present invention.
Figure 5:
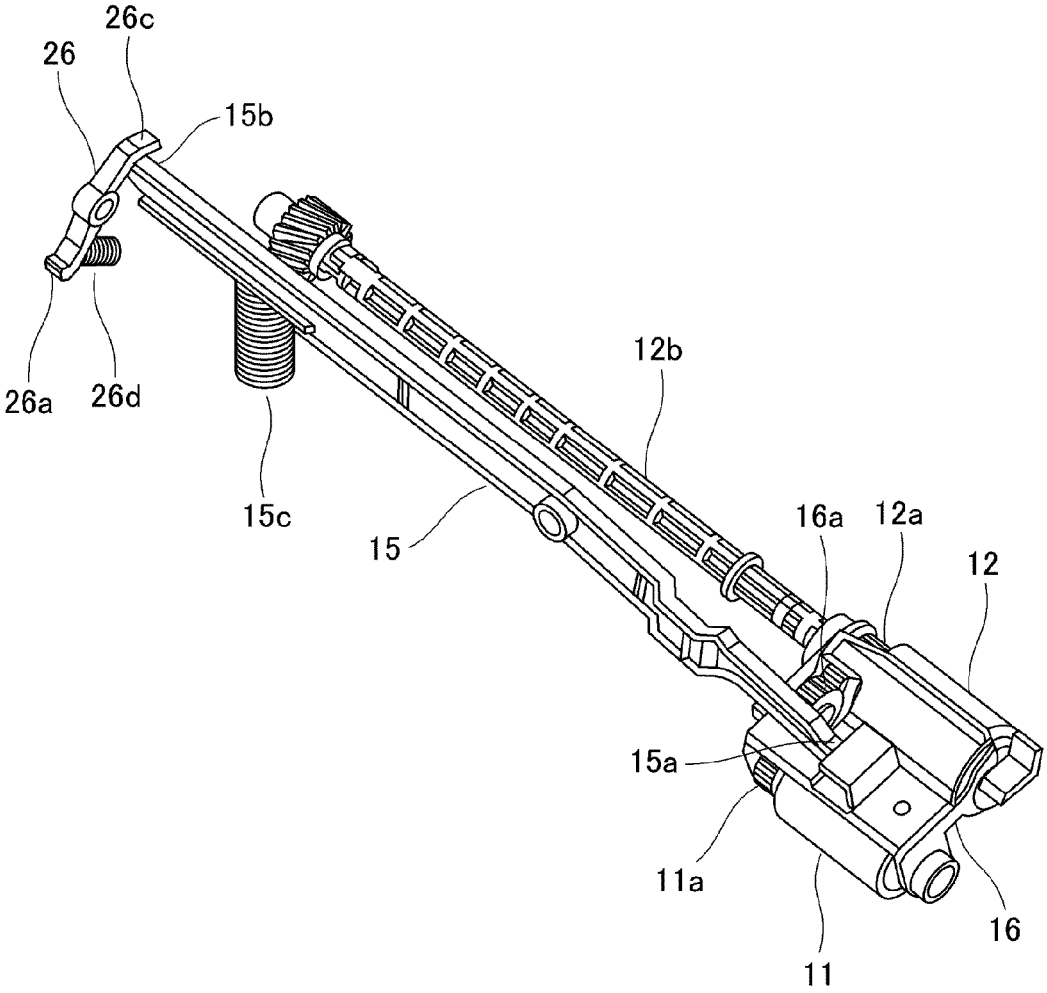
FIG. 5 is a perspective view of the important part illustrating a periphery of a pickup roller according to the embodiment of the present invention.

Next, a configuration and functions of the sheet conveying apparatus 1 will be described with reference to FIG. 3, FIG. 4, and FIG. 5. FIG. 3 is a sectional view illustrating the sheet conveying apparatus in the embodiment of the present invention. FIG. 4 is a perspective view. FIG. 5 is a perspective view depicting a periphery of the pickup roller in the embodiment of the present invention.

As depicted in FIG. 3 and FIG. 4, the sheet conveying apparatus 1 chiefly includes a sheet feeding cassette (sheet stacking apparatus) 14, the pickup roller 11, the feed roller 12, a swing arm 15, and a drive mechanism 20.

The sheet feeding cassette 14 chiefly includes a sheet stacking plate 14*a*, an elevating member 14*b*, a fan-shaped gear 14*c*, separating means 14*d*, and a housing container 14*e*. Sheet materials S are placed on the sheet stacking plate 14*a*, and the elevating member 14*b* elevates the sheet stacking plate 14*a*. The fan-shaped gear 14*c* is coupled to the elevating member 14*b*. The separating means 14*d* faces the feed roller 12. The stacked sheet materials S are housed in the housing container 14*e*. The sheet feeding cassette 14 is removably installed in the image forming apparatus 10 main body. In the present embodiment, the sheet feeding cassette 14 can be installed in and removed from the image forming apparatus 10 by being moved forward or backward (a direction orthogonal to the sheet of FIG. 1) with respect to the image forming apparatus 10 main body.

The pickup roller 11 and the feed roller 12 are provided in the apparatus main body and arranged above the sheet stacking plate 14*a*. In the present embodiment, the pickup roller 11 and the feed roller 12 are integrated into a unit and supported by a roller holder 16 as depicted in FIG. 5.

On one end surface of the feed roller 12, a drive shaft 12*b* is provided and a gear 12*a* is also provided that rotates integrally with the feed roller 12. On the end surface of the pickup roller 11 on the side where the gear 12*a* is provided, a gear 11*a* rotating integrally with the pickup roller 11 is provided. The gear 11*a* is connected to a gear 12*a* via an intermediate gear 16*a*. A drive shaft 12*b* is coupled to a drive member such as a motor (not depicted in the drawings). The drive shaft 12*b* is subjected to motive power to rotate to allow the feed roller 12 and the pickup roller 11 to rotate in the same direction.

The roller holder 16 can swing around an axis of the feed roller 12, and a first end 15*a* of swing arm 15 is coupled to the pickup roller 11 side of the roller holder 16. The swing arm 15 is provided in the same direction as that in which the drive shaft 12*b* extends, and is supported so as to be able to swing.

A bias member 15*c* is provided at a second end 15*b* of the swing arm 15 that is not coupled to the roller holder 16. The bias member 15*c* biases the swing arm 15 in a direction in which the pickup roller 11 is biased toward the sheet stacking plate 14*a* via the roller holder 16. Thus, the pickup roller 11 contacts the sheet materials S placed on the sheet stacking plate 14*a*.

On the other hand, inside the housing container 14*e* forming a framework of the sheet feeding cassette 14, the sheet stacking plate 14*a* is provided on which the sheet materials S are stacked. A downstream side of the sheet stacking plate 14*a* in a conveying direction for the sheet material S moves up and down around an axis of swing 14*f*.

Inside the housing container 14*e*, the elevating member 14*b* is provided that contacts a lower surface of the sheet stacking plate 14*a* and rotates around an axis of rotation 14*g* to elevate and lower the sheet stacking plate 14*a*. As depicted in FIG. 4, the elevating member 14*b* is coupled to the drive mechanism 20 provided outside the sheet feeding cassette 14 and on an apparatus main body side via the fan-shaped gear 14*c*.

With the sheet feeding cassette 14 installed in the image forming apparatus 10, the drive mechanism 20 performs operation to rotate the fan-shaped gear 14*c*, and the elevating member 14*b* rotates according to the amount of the rotation of the fan-shaped gear 14*c*. Then, the sheet stacking plate 14*a* is elevated. When the drive mechanism 20 stops operation, the sheet stacking plate 14*a* holds the orientation thereof.

The separating means 14*d* is provided on the sheet feeding cassette 14 side. When the sheet feeding cassette 14 is installed in the apparatus main body, the separating means 14*d* comes into contact with the feed roller 12 to apply a predetermined conveying resistance to the fed sheet material S. Thus, even if the pickup roller 11 feeds out a plurality of the sheet materials S on the sheet stacking plate 14*a*, one of the sheet materials S is separated from the others by the feed roller 12 and the separating means 14*d*. This prevents a plurality of sheet materials S from being fed downstream.

When the pickup roller 11 sequentially feeds the sheet materials S, a decrease in the number of sheet materials S causes the roller holder 16 to rotationally swing toward the sheet stacking plate 14*a*. The rotational swing of the roller holder 16 allows the swing arm 15 to also swing rotationally. The first end 15*a* of the swing arm 15 lowers toward the sheet stacking plate 14*a* to displace a second end 15*b* of the swing arm 15 upward. When the second end 15*b* is located above a predetermined position, the drive mechanism 20 starts operation to pivot the fan-shaped gear 14*c* by a predetermined amount to rotate the elevating member 14*b*. The sheet stacking plate 14*a* is elevated in conjunction with a decrease in the number of sheet materials S to keep the contact pressure between the pickup roller 11 and the sheet material S within a given range.

In the above-described configuration, the sheet materials S placed in the sheet stacking plate 14*a* are fed by the pickup roller 11, and one of the sheet material S is separated from the others by the feed roller 12 and the separating means 14*d*. Subsequently, the separated sheet material S is sandwiched between the paired registration rollers 13 and conveyed to the secondary transfer means 6 at a predetermined timing.

Detailed Description of the Configuration of the Drive Mechanism

Now, with reference to FIGS. 6 to 17, description will be given that relates to a configuration and functions of the drive mechanism 20 that transmits driving to the fan-shaped gear 14*c* in conjunction with a decrease in the number of sheet material S such that the elevating member 14*b* rotates.

Figure 7:
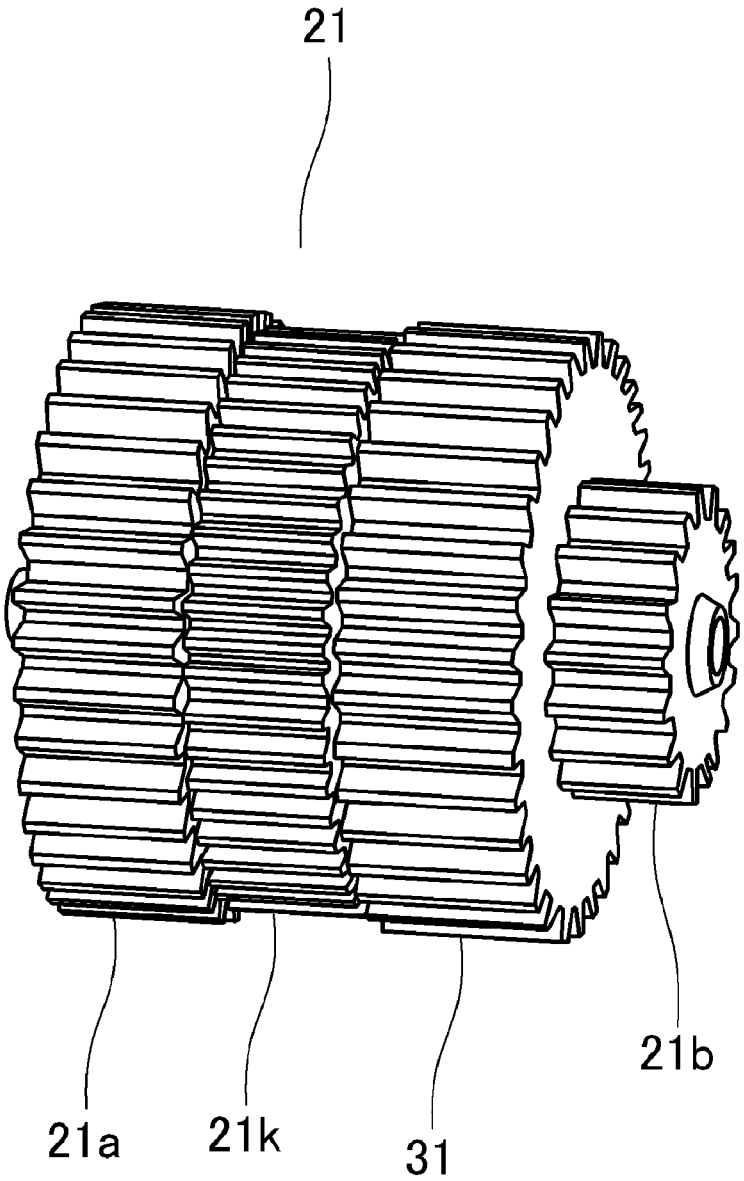
FIG. 7 is a perspective view of a clutch gear according to the embodiment of the present invention.
Figure 8:
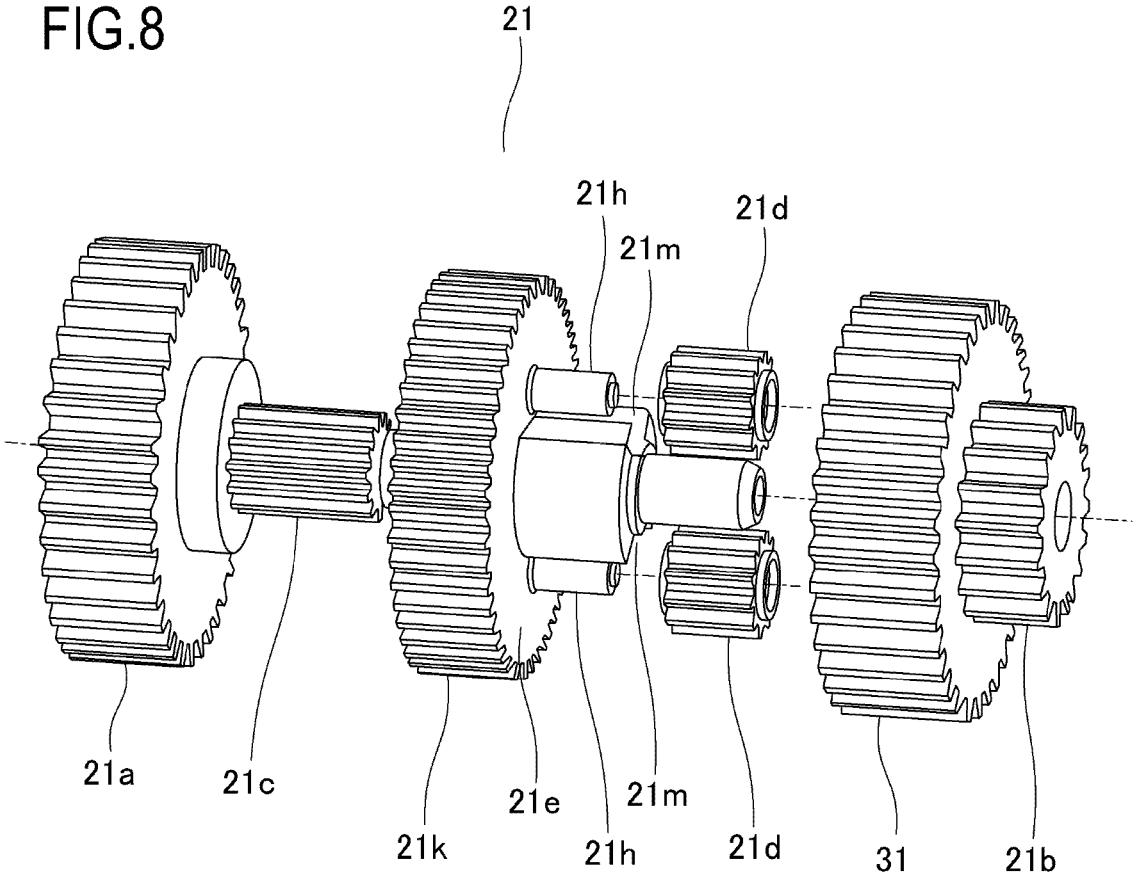
FIG. 8 is an exploded perspective view of the clutch gear according to the embodiment of the present invention.
Figure 9:
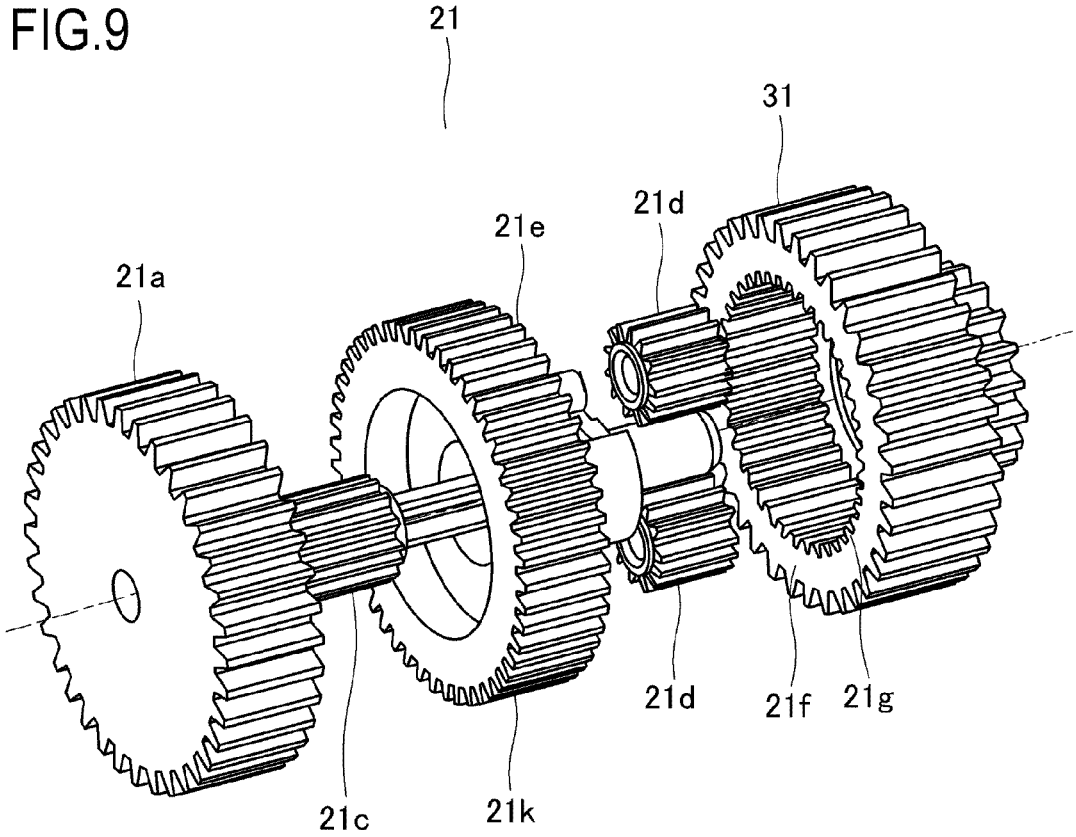
FIG. 9 is an exploded perspective view of the clutch gear according to the embodiment of the present invention.
Figure 11:
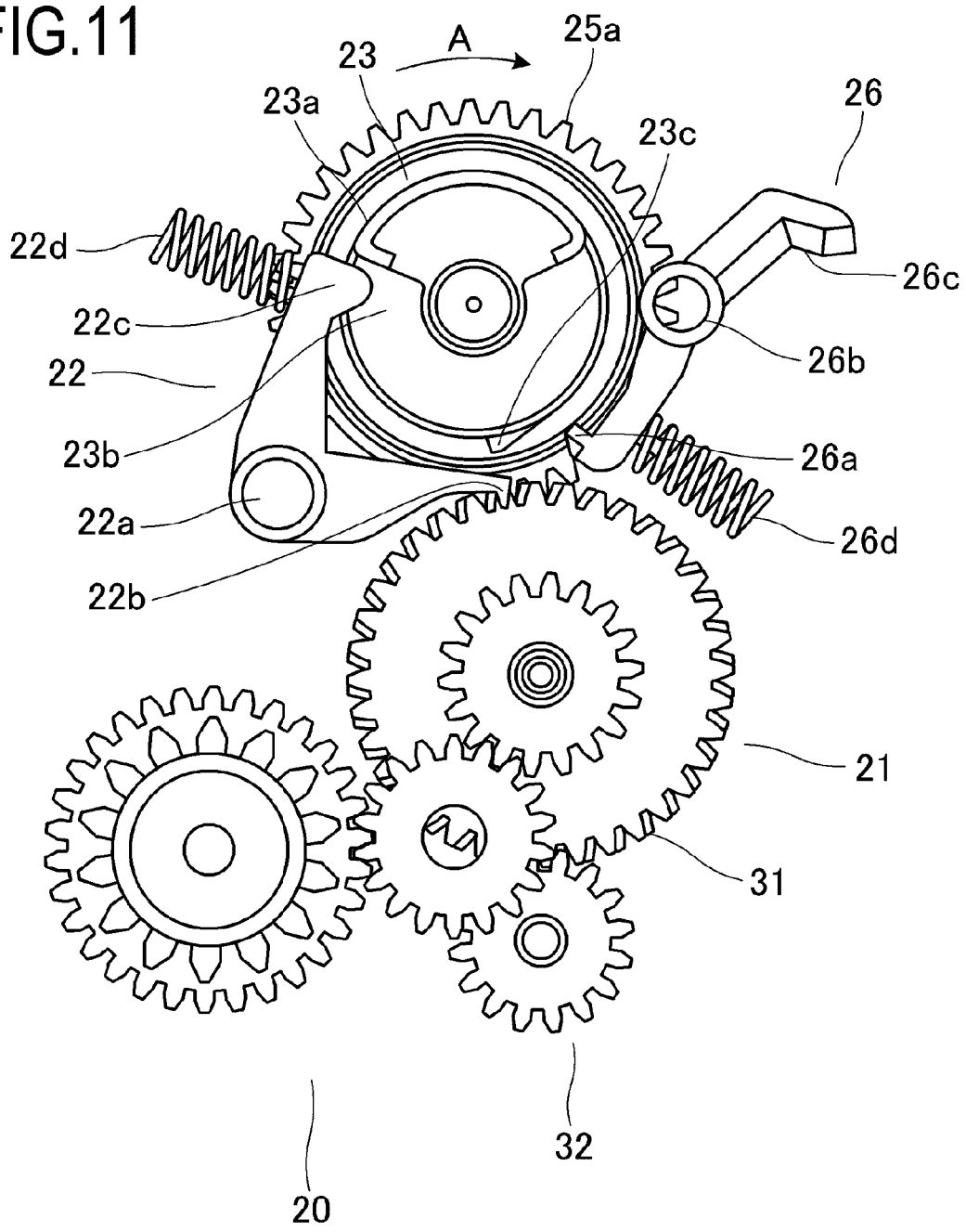
FIG. 11 is a sectional view of the important part of the drive apparatus according to the embodiment of the present invention.
Figure 12:
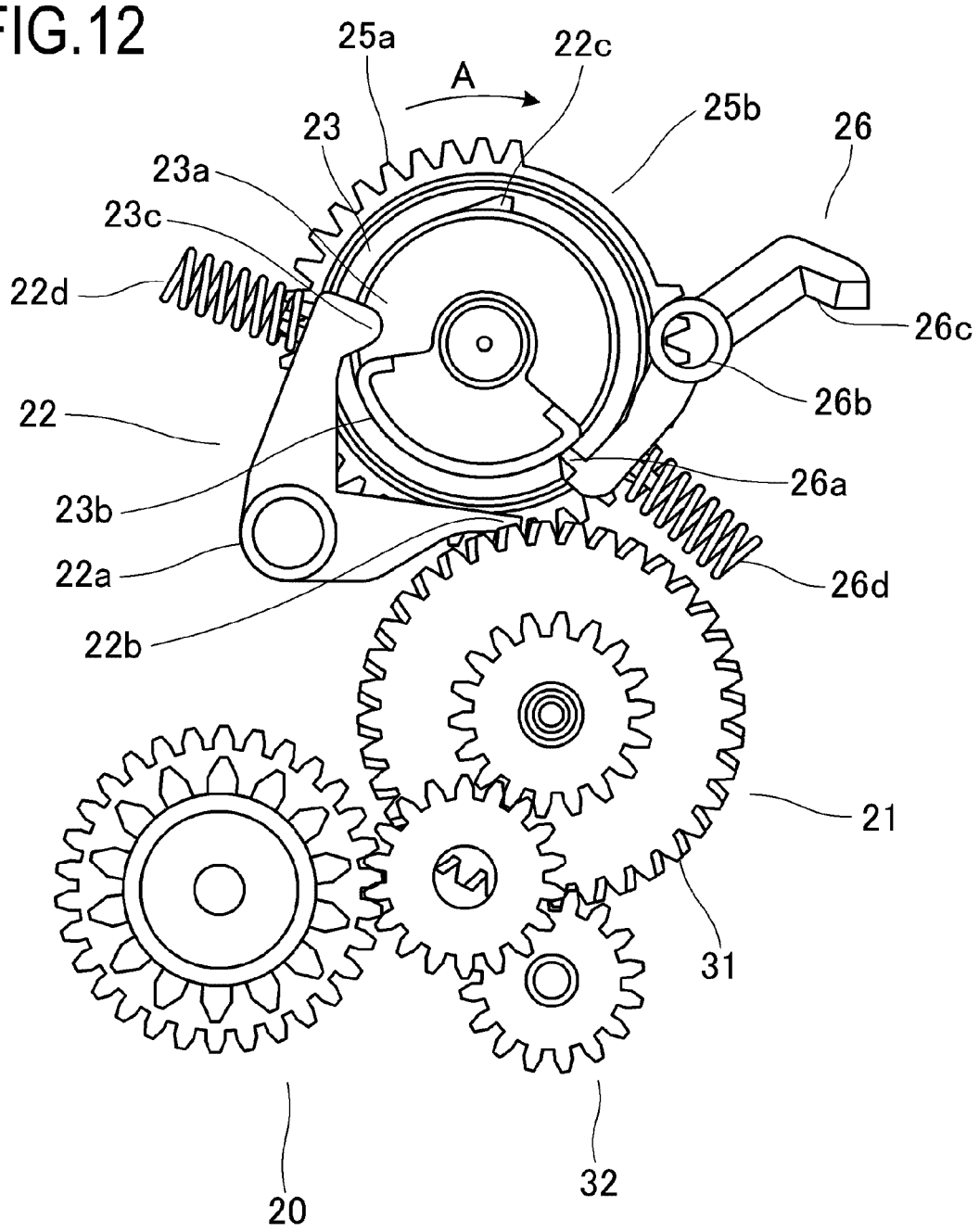
FIG. 12 is a sectional view of the important part of the drive apparatus according to the embodiment of the present invention.
Figure 13:
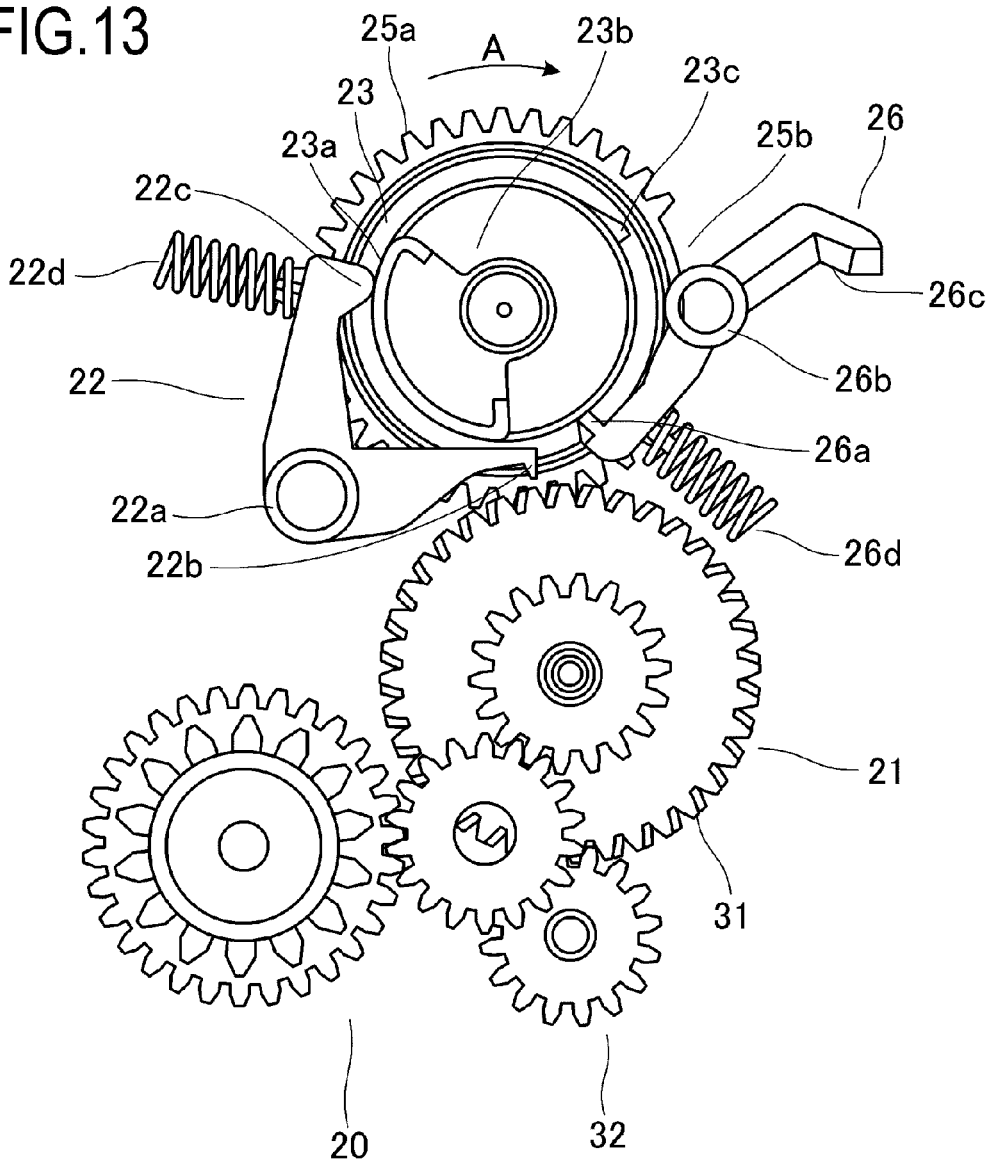
FIG. 13 is a sectional view of the important part of the drive apparatus according to the embodiment of the present invention.
Figure 14:
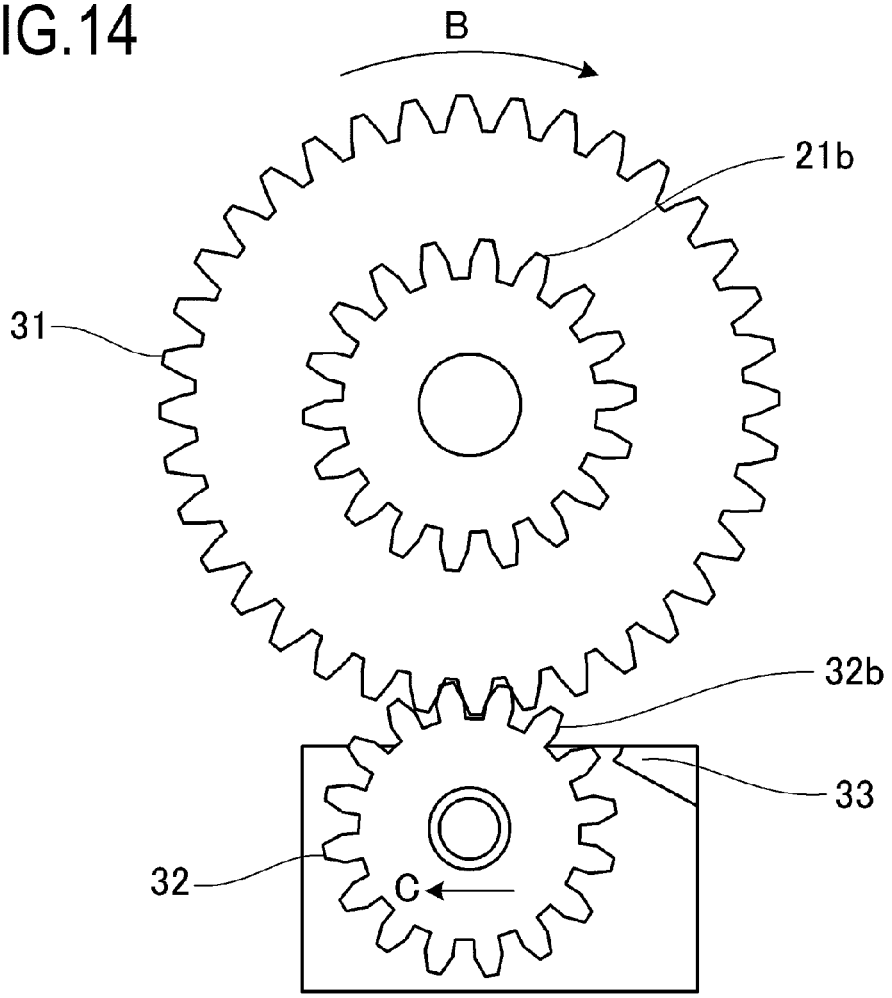
FIG. 14 is a front view of an important part of a driven gear according to Embodiment 1 of the present invention illustrating a first support position of the driven gear.

As described in FIG. 11, the drive mechanism 20 chiefly includes a clutch gear 21, a switching member 22, a cam member 23, a drive gear (first rotating member) 31, and a driven gear (second rotating member) 32. As depicted in FIG. 7, FIG. 8, and FIG. 9, the clutch gear 21 chiefly includes an input gear 21*a* and an output gear 21*b*.

Figure 6:
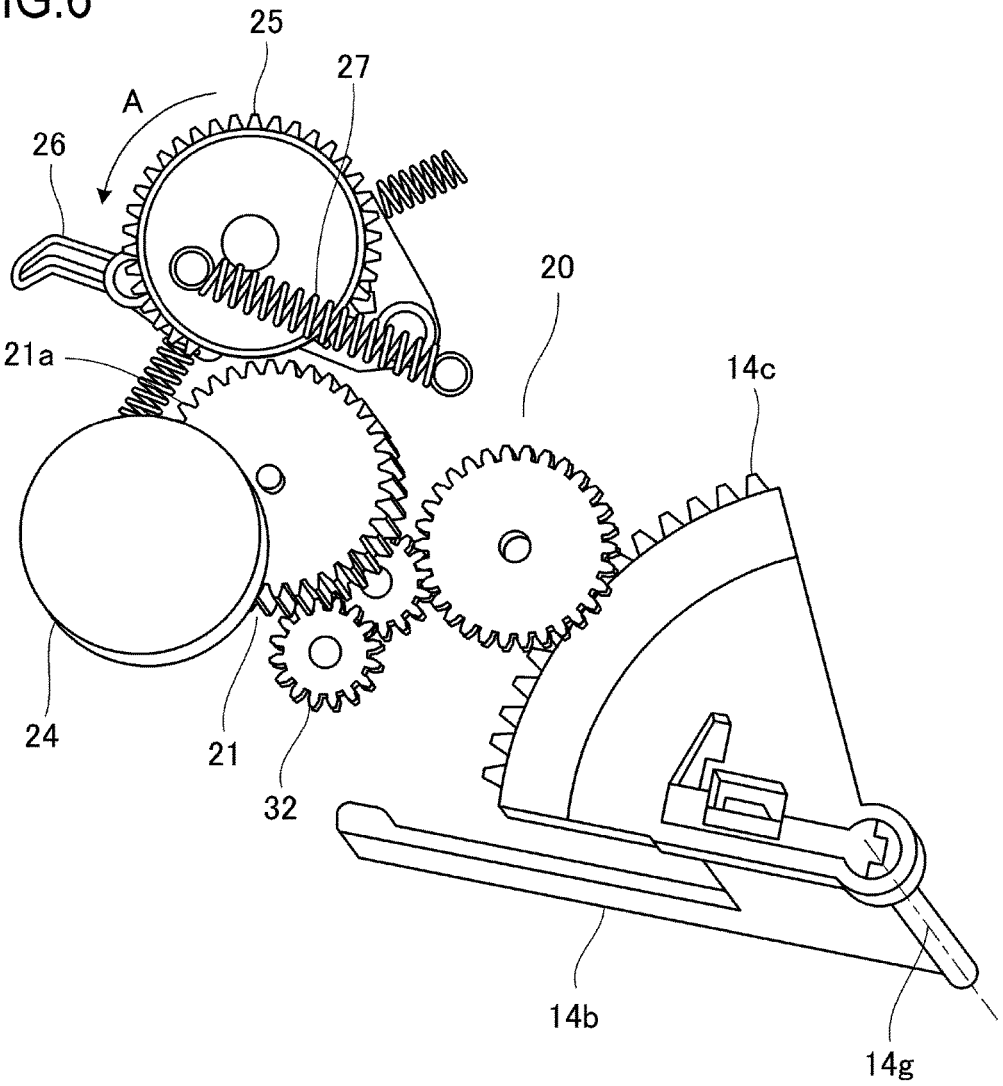
FIG. 6 is a perspective view of an important part of a drive apparatus and an elevating member according to the embodiment of the present invention.

As shown in FIG. 14 to FIG. 17, the drive gear 31 and the driven gear 32 have tooth profiles that allow the gears 31 and 32 to mesh with each other to transmit a rotational drive force. In the present embodiment, the drive gear 31 and the driven gear 32 are spur gears. As depicted in FIG. 6, a drive force received from a drive member 24 is output via the clutch gear 21 to the fan-shaped gear 14*c* provided on the sheet feeding cassette 14. Consequently, rotation of the output gear 21*b* rotates the fan-shaped gear 14*c* to pivot the elevating member 14*b*, thus elevating the sheet stacking plate 14*a*.

In the present embodiment, in the clutch gear 21 transmission of a drive force from the input gear 21*a* to the output gear 21*b* is enabled and disabled by a clutch mechanism including a planetary gear.

As depicted in FIG. 6, FIG. 7, and FIG. 8, the clutch gear 21 has a sun gear 21*c*, a planetary gear 21*d*, a holder 21*e*, and an internal gear 21*f* all arranged between the input gear 21*a* and the output gear 21*b*; the gears 21*a* to 21*f* are integrated into a unit.

The components of the clutch gear 21 in the present embodiment will be described in order from left to right in FIG. 8. The input gear 21*a* is coupled to the drive member 24 such as a motor and rotates when supplied with a drive force from the drive member 24. The sun gear 21*c* is integrated with the input gear 21*a* so as to share the same axis of rotation. The sun gear 21*c* rotates in conjunction with rotation of the input gear 21*a*.

The holder 21*e* is disposed so as to share the same central axis of rotation with the sun gear 21*c*. The holder 21*e* is supported so as to be rotatable around the central axis of rotation of the sun gear 21*c*. The holder 21*e* is provided with a shaft portion 21*h* that holds the planetary gear 21*d* so as to make the planetary gear 21*d* rotatable. The holder 21*e* also includes a plurality of engagement portions 21*k* provided on a cylindrical outer peripheral surface of the holder 21*e*.

The planetary gear 21*d* is configured to mesh with a toothing 21*g* of the internal gear 21*f* (see FIG. 9) and with a toothing of the sun gear 21*c* through an opening hole 21*m*. In the present embodiment, two planetary gears 21*d* are disposed at symmetric positions with respect to the sun gear 21*c*. The internal gear 21*f* is disposed so as to share the same central axis of rotation with the sun gear 21*c*. The toothing 21*g* provided on the cylindrical inner peripheral surface is in a meshing relation with the planetary gear 21*d*.

In the present embodiment, the internal gear 21*f* is integrated with the output gear 21*b* and the drive gear 31 so as to share the same axis of rotation. The output gear 21*b* and the drive gear 31 rotate in conjunction with rotation of the internal gear 21*f*.

In the above-described configuration, with the input gear 21*a* rotating, the clutch gear 21 permits rotation of the holder 21*e*. In this case, the output gear 21*b* suffers a higher resistance than the holder 21*e*, and thus, the planetary gear 21*d* only turns around the sun gear 21*c* and transmits no drive force to the internal gear 21*f*. That is, transmission of a drive force from the input gear 21*a* to the output gear 21*b* is interrupted (off).

On the other hand, with the input gear 21*a* not rotating, rotation of the holder 21*e* is regulated. In this case, the output gear 21*b* suffers a lower rotational resistance than the holder 21*e*, and thus, the planetary gear 21*d* rotates on the shaft portion 21*h* instead of turning around the sun gear 21*c*. The planetary gear 21*d* thus transmits a drive force to the internal gear 21*f*. That is, a drive force is transmitted from the input gear 21*a* to the output gear 21*b* (on).

Figure 10:
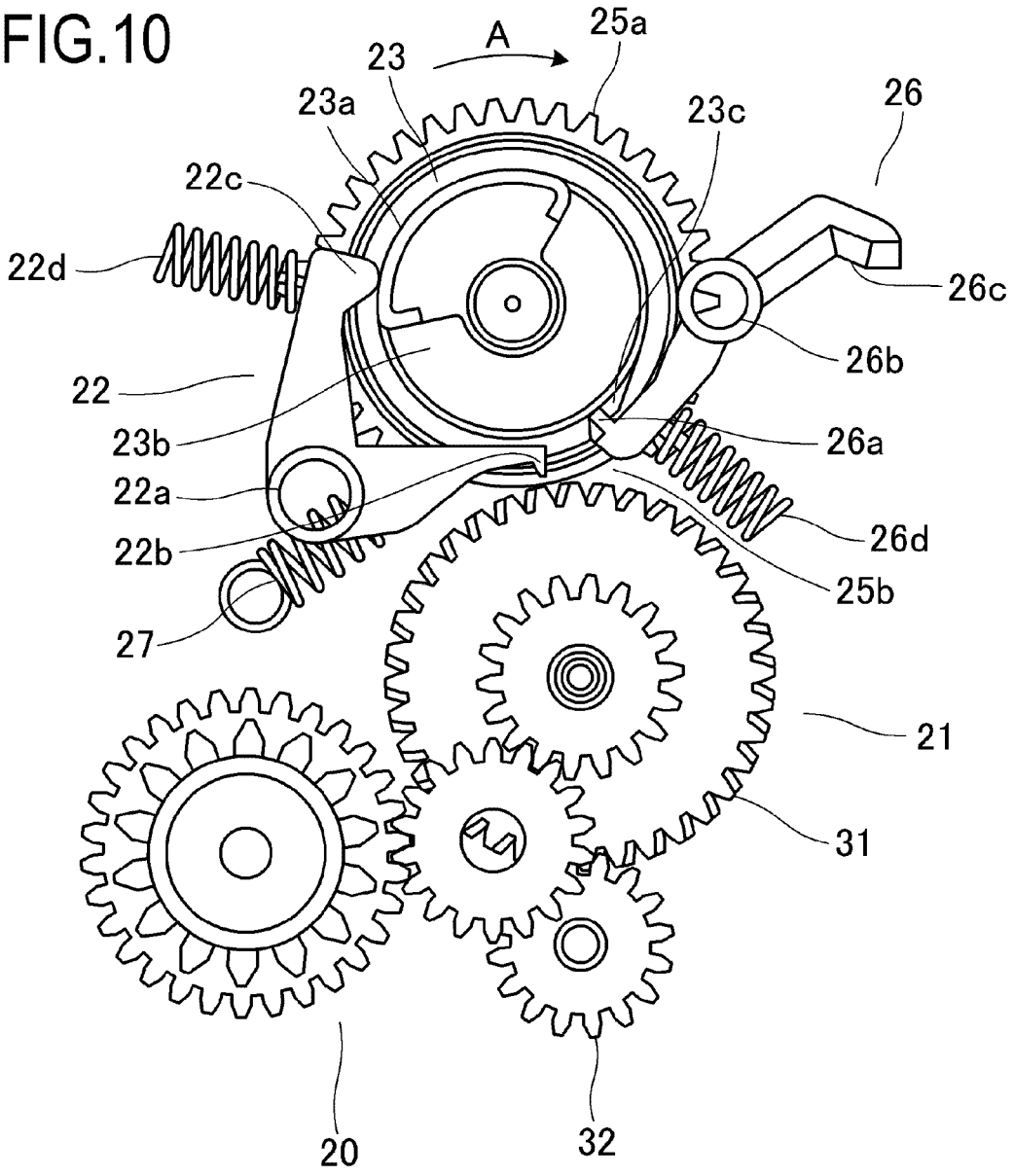
FIG. 10 is a sectional view of an important part of a drive apparatus according to an embodiment of the present invention.

As depicted in FIG. 10, a switching member 22 is provided to switch between an on state and an off state of the clutch gear 21. The switching member 22 is shaped like an arm and can swing around a swing shaft 22*a*. A pawl portion 22*b* is provided at a first end of the switching member 22 so as to be able to switch between a state where the pawl portion 22*b* engages with the engagement portion 21*k* of the holder 21*e* and a state where the pawl portion 22*b* is separated from the engagement portion 21*k* (see FIGS. 10 to 13).

A second end 22*c* of the switching member 22 is disposed so as to come into contact with a cam surface 23*a* provided on an outer peripheral surface of a cam member 23. A bias member 22*d* is provided so as to bias the switching member 22 toward the cam surface 23*a*. Therefore, a swinging orientation of the switching member 22 is controlled by the shape of the outer peripheral surface of the cam member 23.

Thus, while the cam member 23 is rotating with the second end 22*c* of the switching member 22 in contact with the cam surface 23*a*, the pawl portion 22*b* separates from the engagement portion 21*k*. When the second end 22*c* is located in the area of a depressed portion 23*b* of the cam member 23, the pawl portion 22*b* and the engagement portion 21*k* engage with each other. In other words, while the second end 22*c* of the switching member 22 is in contact with the cam surface 23*a*, the clutch gear 21 is in the off state. While the second end 22*c* is located in the area of the depressed portion 23*b*, the clutch gear 21 is in the on state.

The cam member 23 is provided with a partially non-toothed gear 25 integrated with the cam surface 23*a* and the like. Rotation of the cam member 23 allows the partially non-toothed gear 25 to rotate along with the cam surface 23*a* and the like. As depicted in FIG. 10, the partially non-toothed gear 25 includes a tooth group 25*a* provided with a tooth profile that allows the partially non-toothed gear 25 to mesh with the input gear 21*a* and a non-toothed portion 25*b* provided with no tooth profile.

A protruded portion 23*c* is provided on the outer peripheral surface of the cam member 23. As depicted in FIG. 10, adjacent to the cam member 23, a cam stopper 26 is disposed that has a pawl portion 26*a* coming into engagement with the protruded portion 23*c*. The cam stopper 26 can swing around a support shaft 26*b* and is supported so as to be displaceable into a state where the pawl portion 26*a* engages with the protruded portion 23*c* and into a state where the pawl portion 26*a* separates from the protruded portion 23*c*. As depicted in FIG. 5, the cam stopper 26 is coupled to the second end 15*b* of the swing arm 15 via a coupling portion 26*c*.

The pawl portion 26*a* of the cam stopper 26 is biased toward the cam member 23 by the bias member 26*d*. Therefore, as the cam member 23 rotates in the direction of arrow A depicted in FIG. 10, the protruded portion 23*c* comes into engagement with the pawl portion 26*a* to stop rotation of the cam member 23. As depicted in FIG. 10, an initial phase of the cam member 23 is defined as a state where the protruded portion 23*c* of the cam member 23 is engaged with the pawl portion 26*a* of the cam stopper 26. When the cam member 23 is in the initial phase, the partially non-toothed portion 25*b* faces the input gear 21*a*, thus preventing the drive force of the input gear 21*a* from being transmitted to the cam member 23.

As depicted in FIG. 6 and FIG. 10, bias means 27 is disposed adjacent to the cam member 23. While the cam member 23 is in the initial phase, the bias means 27 biases the cam member 23 so as to allow the cam member 23 to rotate in the direction of arrow A.

When the swing arm 15 swings until the second end 15*b* of the swing arm 15 is displaced to lie above a predetermined position, the cam stopper 26 is swung such that the pawl portion 26*a* of the cam stopper 26 separates from the protruded portion 23*c* of the cam member 23.

In other words, when the pickup roller 11 is displaced to lie below the predetermined position, the pawl portion 26*a* of the cam stopper 26 is disengaged from the protruded portion 23*c* of the cam member 23 (see FIG. 11). A bias force of the bias means 27 acts on the cam member 23, and thus, the cam member 23 starts rotating in the direction of arrow A to allow the tooth group 25*a* of the partially non-toothed gear 25 to mesh with the input gear 21*a*. Subsequently, the second end 22*c* of the switching member 22 moves to the area of the depressed portion 23*b* of the cam member 23. This brings the clutch gear 21 into the on state to elevate the sheet stacking plate 14*a*. Subsequently, the tooth group 25*a* of the partially non-toothed gear 25 remains meshed with the input gear 21*a*, thus allowing the cam member 23 to further rotate (see FIG. 12).

Also at this time, the second end 22*c* of the switching member 22 is positioned in the area of the depressed portion 23*b* of the cam member 23. Thus, the clutch gear 21 is in the on state, and the sheet stacking plate 14*a* continues to elevate. Subsequently, as the cam member 23 further rotates, the second end 22*c* of the switching member 22 moves to the area of the cam surface 23*a* of the cam member 23. This brings the clutch gear 21 into the off state to stop elevating the sheet stacking plate 14*a* (see FIG. 13). Then, with the partially non-toothed portion 25*b* facing the input gear 21*a* and with the protruded portion 23*c* of the cam member 23 engaged with the pawl portion 26*a* of the cam stopper 26, the cam member 23 stops rotating (see FIG. 10).

At this time, the second end 15*b* of the swing arm 15 is located below the predetermined position, the pawl portion 26*a* of the cam stopper 26 is biased toward the cam member 23 to engage the protruded portion 23*c* with the pawl portion 26*a*. Thus, as depicted in FIG. 10, the cam member 23 is in the initial phase.

In the above-described configuration, when the pickup roller 11 is displaced to lie below the predetermined position, the sheet stacking plate 14*a* elevates by a predetermined amount in conjunction with a rotating operation of the cam member 23. This keeps the contact pressure between the pickup roller 11 and the sheet material S within a given range.

As described above, the drive gear 31 (large-diameter gear) and the output gear 21*b* (small-diameter gear) are integrated together so as to share the same axis of rotation to form a multistage gear. When the clutch gear 21 turns into the on state to rotate the output gear 21*b*, the drive gear 31 also rotates in the same direction.

As depicted in FIGS. 14 to 17, the driven gear 32 is disposed so as to mesh with the drive gear 31. The driven gear 32 has a shaft portion 32*a* and is supported by a guide hole (support means) 34 formed in a frame of the sheet feeding cassette 14 serving as a support member such that the driven gear 32 is rotatable and movable through the guide hole 34 relative to the frame in a circumferential direction around the axis of rotation of the drive gear 31. The guide hole 34 is a circular arc-shaped slot coaxial to the central axis of rotation of the drive gear 31 and formed such that even when the driven gear 32 moves through the guide hole 34, the distance between the center of the drive gear 31 and the center of the driven gear 32 is constant. That is, even when the driven gear 32 moves, the driven gear 32 is guided so as to remain meshed with the drive gear 31.

In the vicinity of the driven gear 32, a protruding portion (locking member, engagement portion) 33 is disposed that engages with a tooth flank 32*b* of the driven gear 32. In this case, forward rotation (rotation in a first direction) refers to a direction in which the drive gear 31 rotates (a direction indicated by arrow B in FIG. 14 and FIG. 15) when the clutch gear 21 is in the on state. Backward rotation refers to a direction opposite to the forward rotation (rotation in a second direction opposite to the first direction).

Figure 15:
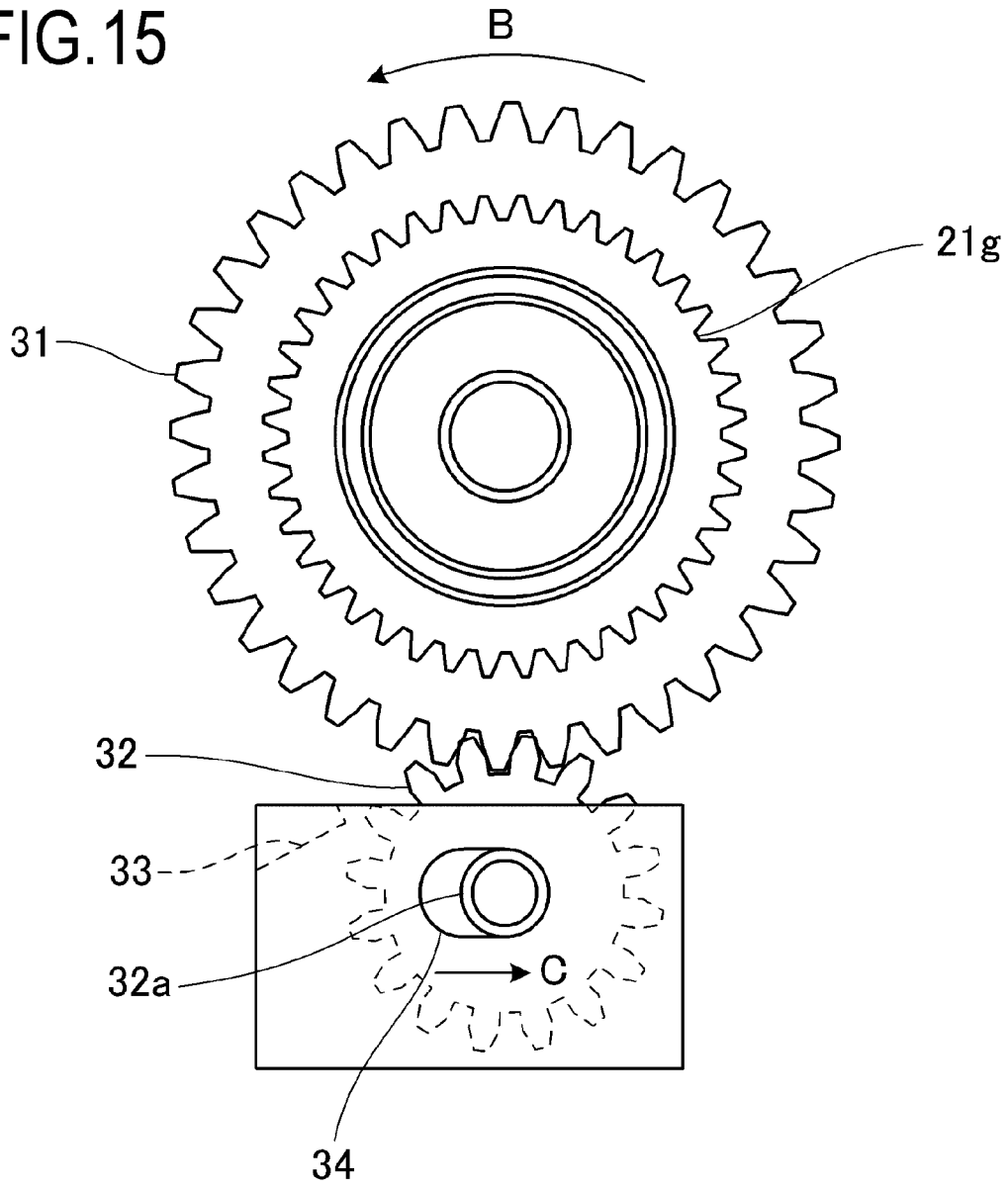
FIG. 15 is a rear view of an important part of a driven gear according to Embodiment 1 of the present invention illustrating a first support position of the driven gear.
Figure 16:
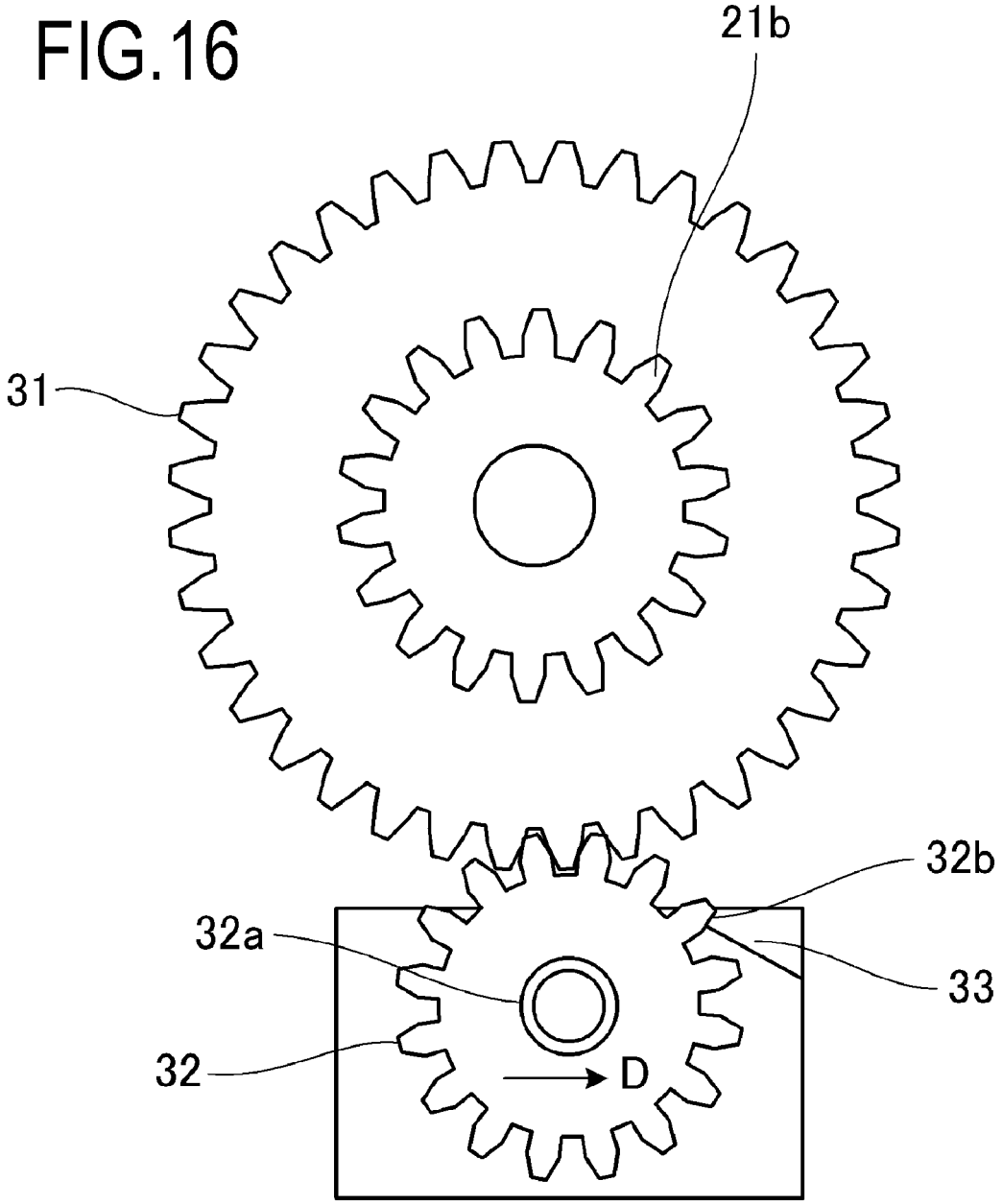
FIG. 16 is a front view of the important part of the driven gear according to Embodiment 1 of the present invention illustrating a second support position of the driven gear.
Figure 17:
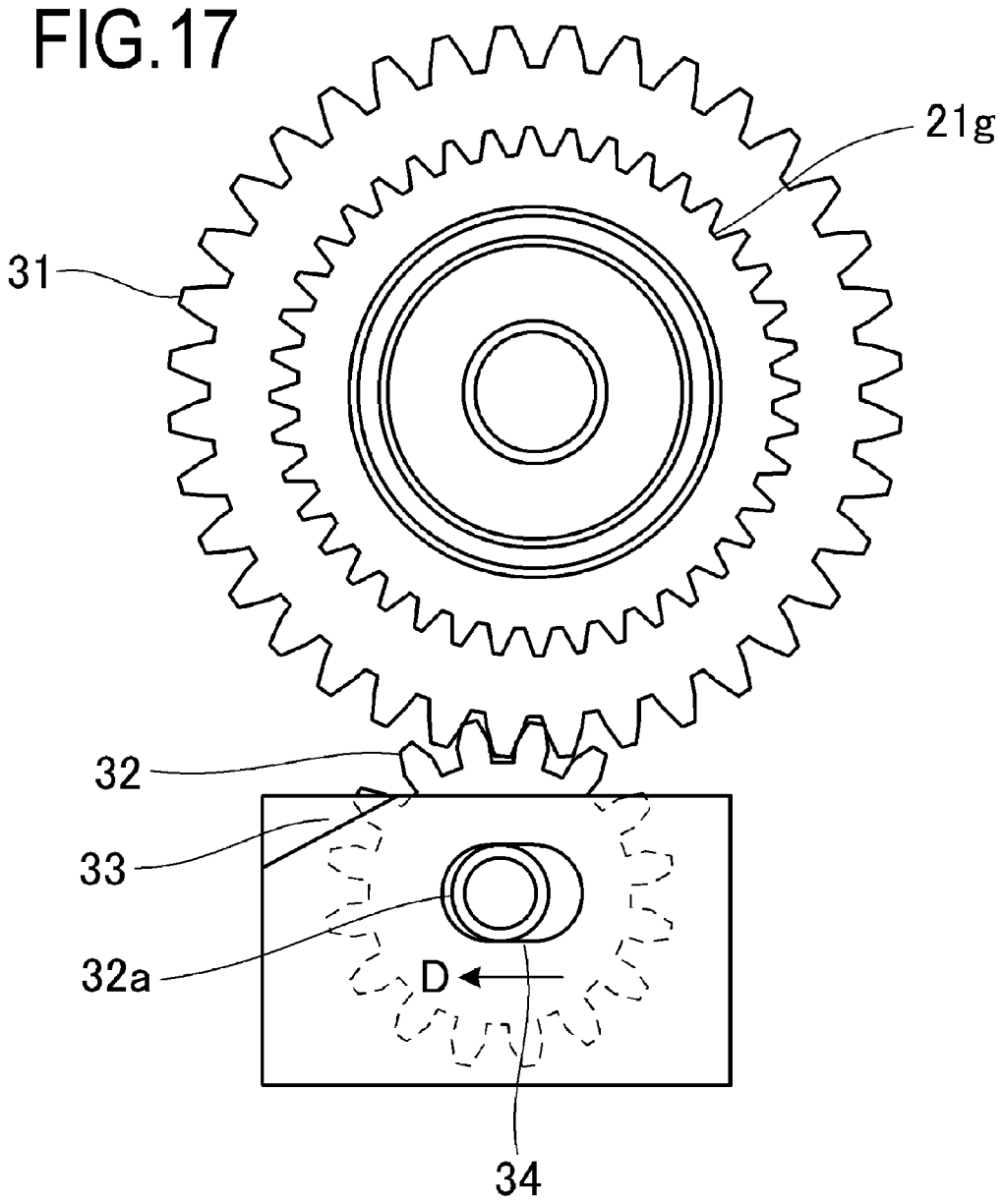
FIG. 17 is a rear view of the important part of the driven gear according to Embodiment 1 of the present invention illustrating a second support position of the driven gear.

Forward rotation of the drive gear 31 allows the driven gear 32 to move through the guide hole 34 in the direction of arrow C depicted in FIG. 15 and to rotate at one side of the guide hole 34 (first support position) in conjunction with the forward rotation. When rotation occurs in the direction in which the drive gear 31 rotates backward, the driven gear 32 moves through the guide hole 34 in the direction of arrow D depicted in FIG. 16 and FIG. 17. Then, at the other side of the guide hole 34 (second position), the tooth flank 32*b* of the driven gear 32 comes into engagement with the protruding portion 33 and is locked by the protruding portion 33. Thus, the driven gear 32 stops rotation. The protruding portion 33 is disposed so as to engage with the tooth flank 32*b* of the driven gear 32 when the driven gear 32 is located at the second position. The protruding portion 33 is also disposed so as to lie away from the tooth flank 32*b* of the driven gear 32 when the driven gear 32 is located at the first support position and is rotating in conjunction with rotation of the drive gear 31.

In other words, when the clutch gear 21 turns into the on state to allow the drive gear 31 to rotate forward, the driven gear 32 rotates in conjunction with the rotation of the drive gear 31 to permit the forward rotation of the drive gear 31. When the clutch gear 21 turns into the off state to displace the sheet stacking plate 14*a* in a lowering direction due to the weight of the sheet material S and the like, that is, to rotate the sheet stacking plate 14*a* in the direction in which the drive gear 31 rotates backward, rotation of the driven gear 32 is inhibited, thus preventing the drive gear 31 from rotating backward.

Since the drive gear 31 and the output gear 21*b* rotate integrally with each other, rotation of the drive gear 31 is interlocked with displacement of the elevating member 14*b*, in other words, displacement of the sheet stacking plate 14*a*. Therefore, in the present embodiment, forward rotation of the drive gear 31 is permitted, whereas rotation is prevented from occurring in the direction in which the drive gear 31 rotates backward. This enables elevation of the sheet stacking plate 14*a* to be permitted, while preventing lowering of the sheet stacking plate 14*a*.

Furthermore, when the drive gear 31 has a larger diameter and a larger number of teeth than the output gear 21*b*, a load can be reduced that is imposed on the tooth flank 32*b* of the driven gear 32 by the protruding portion 33. Moreover, the present embodiment allows minimization of the effect, on the lowering of the sheet stacking plate 14*a*, of movement of the driven gear 32 in the guide hole 34 from the first support position to the second position.

The above-described configuration eliminates the need for arrangement for complicated control such as engagement and separation of the pallet member with respect to the ratchet gear in conjunction with timings for separation and engagement of the switching member. The above-described configuration further eliminates the need for the ratchet gear itself, preventing the generation of noise resulting from collision and retraction of the pallet member with respect to the toothing of the ratchet gear. That is, when the mechanism that drives the sheet stacking plate 14*a* upward or keeps the sheet stacking plate 14*a* stopped is operated, possible noise can be prevented without the need for complicated control.

Embodiment 2

In Embodiment 2, for the driven gear that moves in conjunction with forward or backward movement of the drive gear, a configuration different from the configuration in Embodiment 1 will be described. Only differences between Embodiment 2 and Embodiment 1 will be described. The remaining part of the configuration is the same for both embodiments and will thus not be described below.

Embodiment 2 of the present invention will be described below based on the drawings. FIGS. 18 to 22 are perspective views and side views depicting configurations of a drive gear and a driven gear that serve as a drive mechanism in Embodiment 2 of the present invention.

Figure 18:
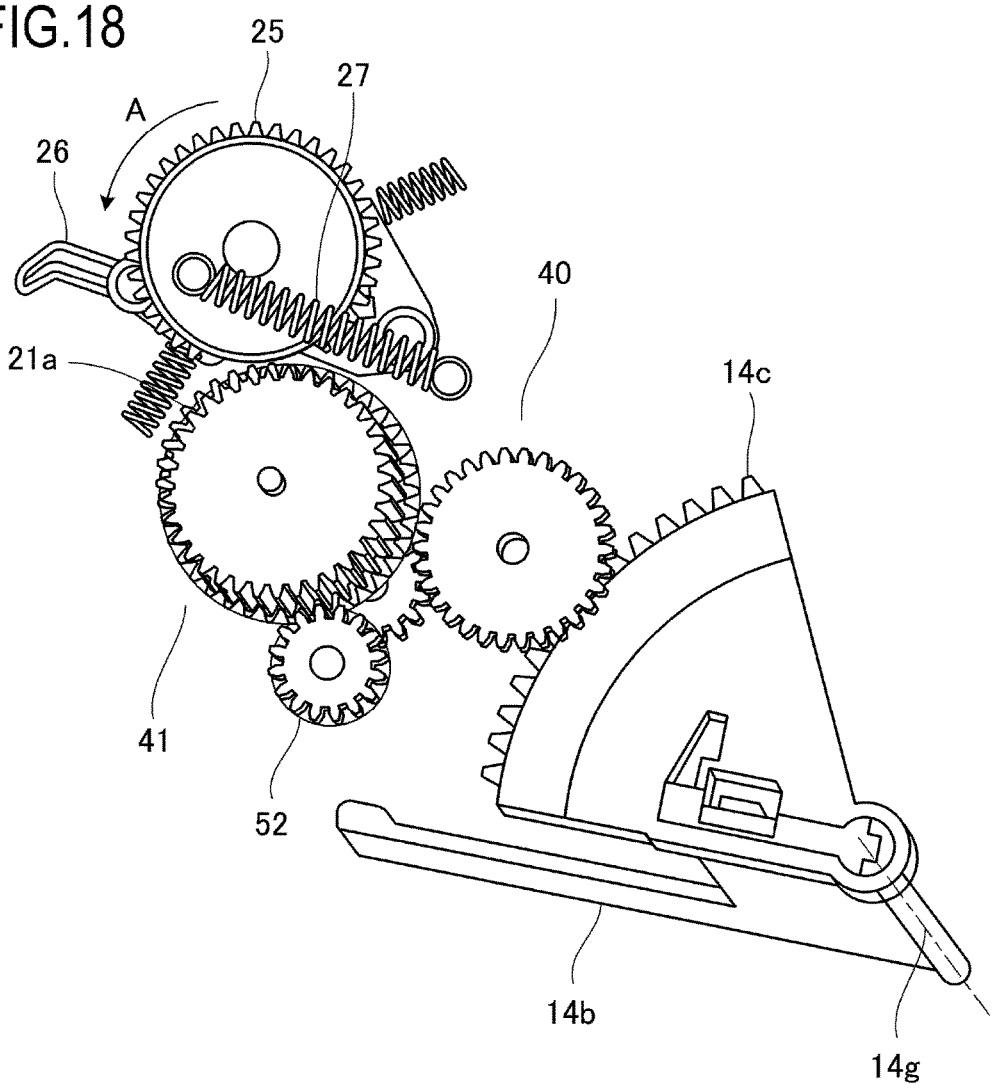
FIG. 18 is a perspective view of an important part of a drive apparatus and an elevating member according to Embodiment 2 of the present invention.
Figure 19:
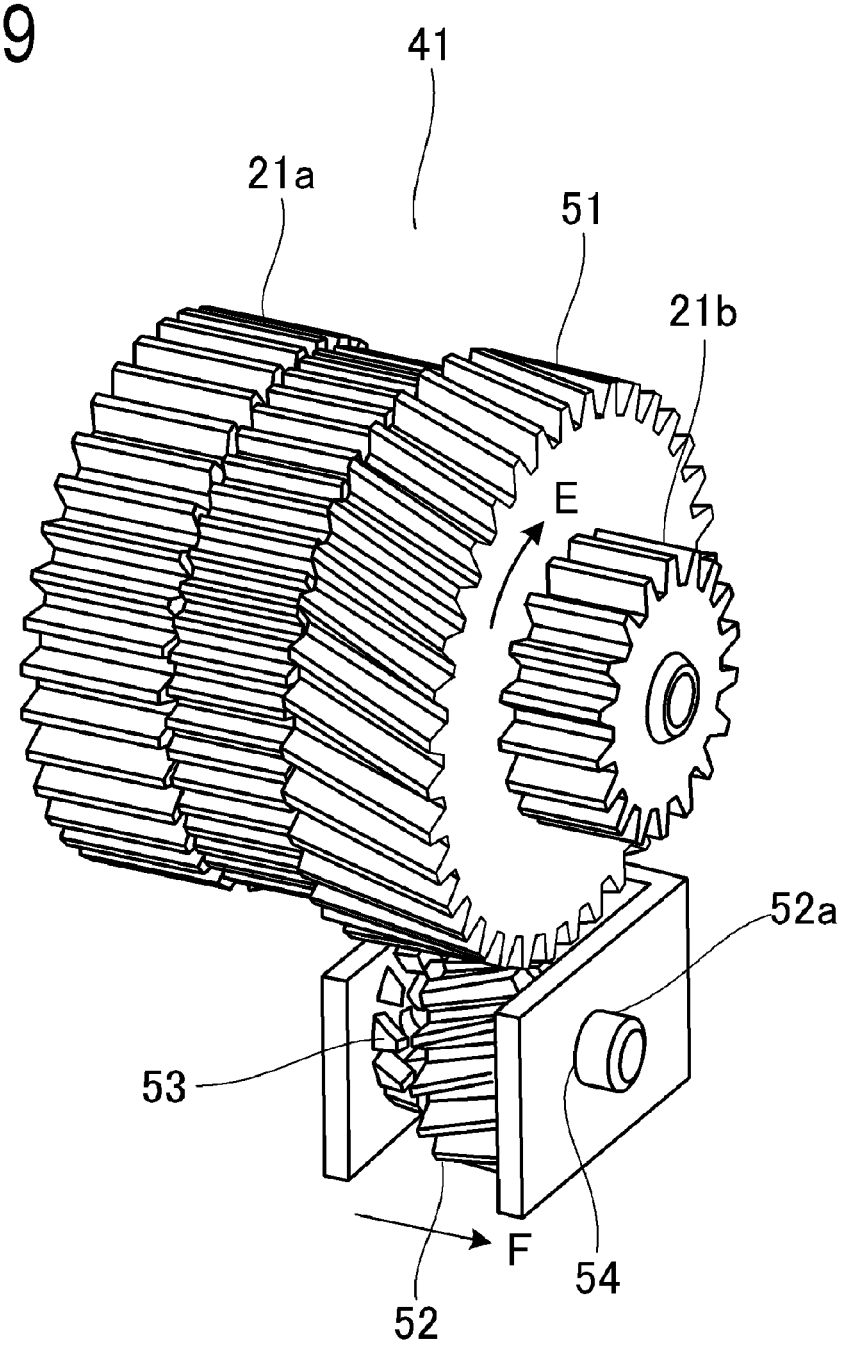
FIG. 19 is a perspective view of an important part of a driven gear according to Embodiment 2 of the present invention illustrating a first support position of the driven gear.

A configuration and functions of a drive mechanism 40 will be described that transmits driving to the fan-shaped gear 14*c* according to a decrease in the number of sheet materials S to pivot the elevating member 14*b* (see FIG. 18).

The drive mechanism 40 chiefly includes a clutch gear 41, the switching member 22, the cam member 23, a drive gear (first rotating member) 51, and a driven gear (second rotating member) 52. The clutch gear 41 chiefly includes the input gear 21*a* and the output gear 21*b*. As depicted in FIGS. 19 to 22, the drive gear 51 and the driven gear 52 have tooth profiles that allow the gears 51 and 52 to mesh with each other to transmit a rotational drive force. In the present embodiment, the drive gear 51 and the driven gear 52 are helical gears.

In the clutch gear 41, transmission of a drive force from the input gear 21*a* to the output gear 21*b* is enabled and disabled by a clutch mechanism including a planetary gear as is the case with Embodiment 1.

In the present embodiment, the drive gear (large-diameter gear) 51, the internal gear 21*f*, and the output gear (small-diameter gear) 21*b* are integrated together so as to share the same axis of rotation to form a multistage gear. The output gear 21*b* and the drive gear 51 rotate in conjunction with rotation of the internal gear 21*f* Consequently, when the clutch gear 41 turns into the on state to rotate the output gear 21*b*, the drive gear 51 also rotates in the same direction.

The driven gear 52 is disposed so as to mesh with the drive gear 51. The driven gear 52 has a shaft portion 52*a* and is supported by a support hole (support means, support portion) 54 formed in the frame of the sheet feeding cassette 14 serving as a support member such that the driven gear 32 is rotatable and movable relative to the frame in the direction of the axis of rotation.

Since the drive gear 51 and the driven gear 52 are helical gears, when the drive gear 51 and the driven gear 52 mesh with each other and rotate to transmit a force, a thrust is generated in the direction of the axis of rotation of each gear according to a hand of helix of the tooth profile. When the driven gear 52 rotates in conjunction with rotation of the drive gear 51, if a resistance resulting from movement in the direction of the axis of rotation under the thrust is lower than a rotational resistance generated while the driven gear 52 rotates in conjunction with rotation of the drive gear 51, the driven gear 52 moves in the direction of the axis of rotation.

Protruding portions 52*b* are provided on an end surface of the driven gear 52. In the vicinity of the driven gear 52, engagement portions (locking members) 53 are disposed that come into engagement with the protruding portions 52*b* of the driven gear 52 to stop rotation of the driven gear 52.

In the present embodiment, forward rotation refers to a direction (the direction of arrow E depicted in FIG. 19) in which the drive gear 51 rotates when the clutch gear 41 is in the on state. Backward rotation refers to a direction opposite to the forward rotation. Forward rotation of the drive gear 51 allows the driven gear 52 to move in the direction of arrow F depicted in FIG. 19 and FIG. 20 and to rotate at one side of the direction of the axis of rotation (first support position). When rotation occurs in a direction in which the drive gear 51 rotates backward, the driven gear 52 moves in the direction of arrow G depicted in FIG. 21 and FIG. 22. Then, at the other side of the direction of the axis of rotation (second position), the protruding portions 52*b* of the driven gear 52 come into engagement with the engagement portion 53 and are locked by the engagement portion 53. Thus, rotation of the driven gear 52 is regulated.

Figure 20:
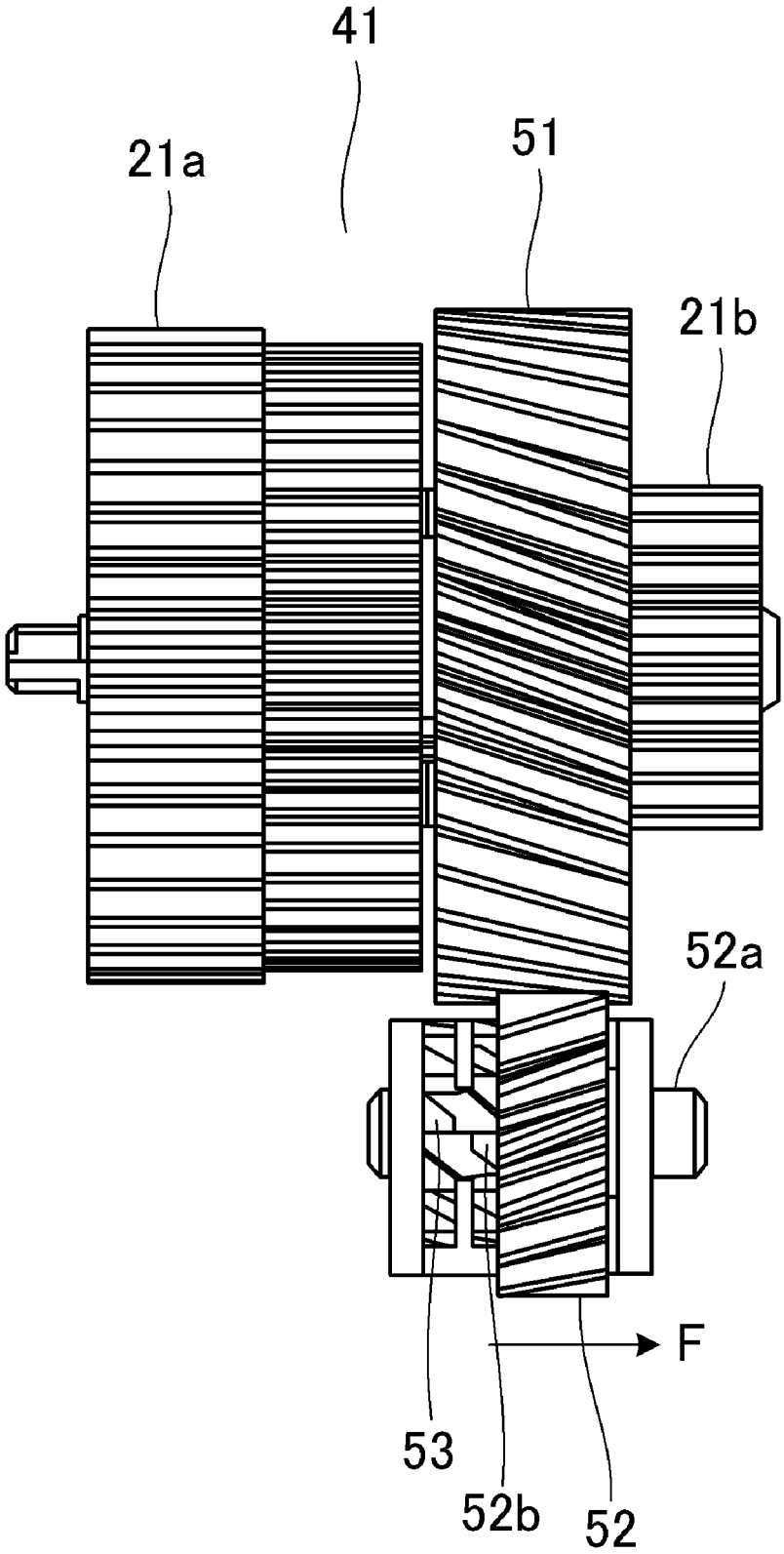
FIG. 20 is a side view of the important part of the driven gear according to Embodiment 2 of the present invention illustrating the first support position of the driven gear.
Figure 21:
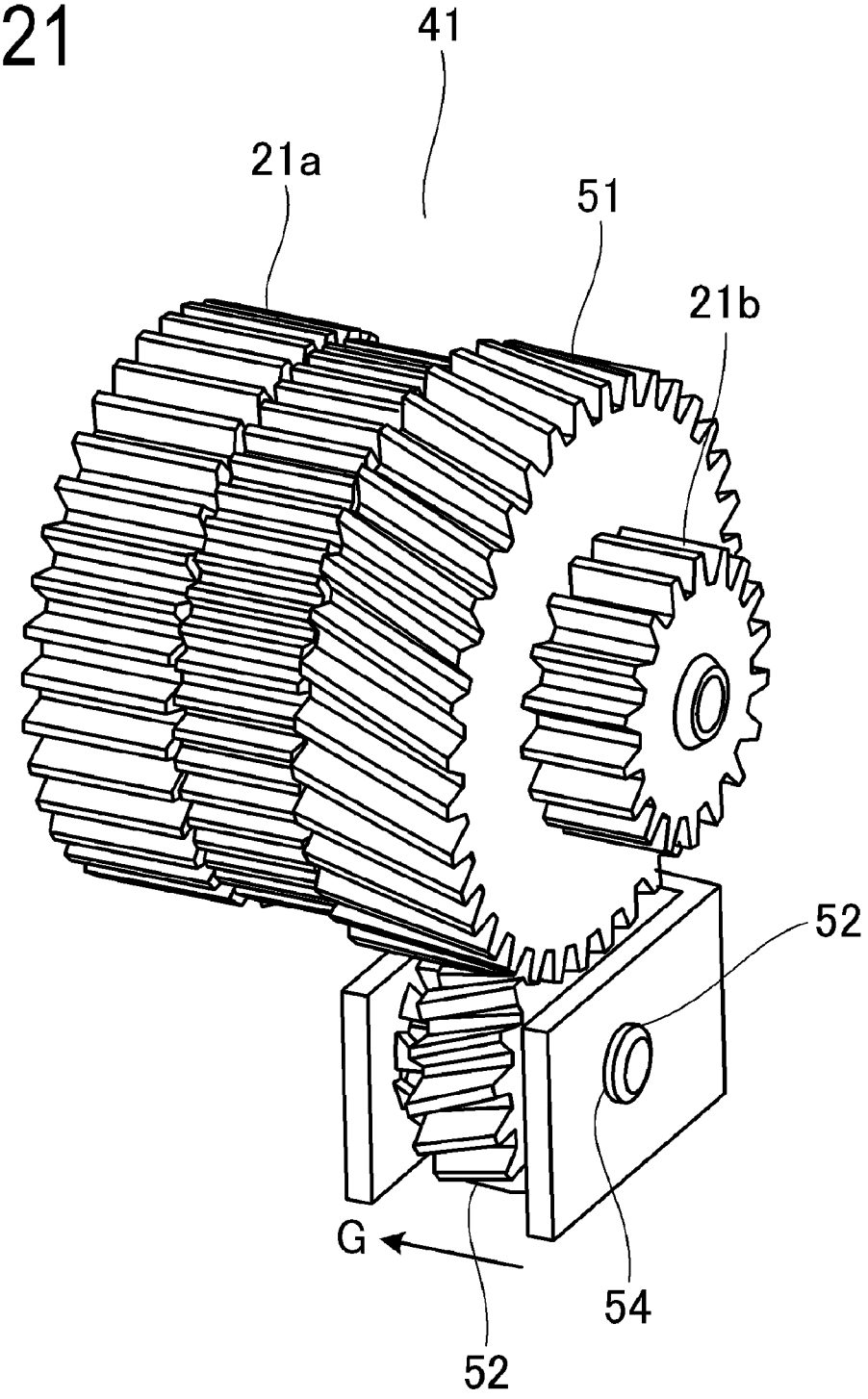
FIG. 21 is a perspective view of the important part of the driven gear according to Embodiment 2 of the present invention illustrating a second support position of the driven gear.
Figure 22:
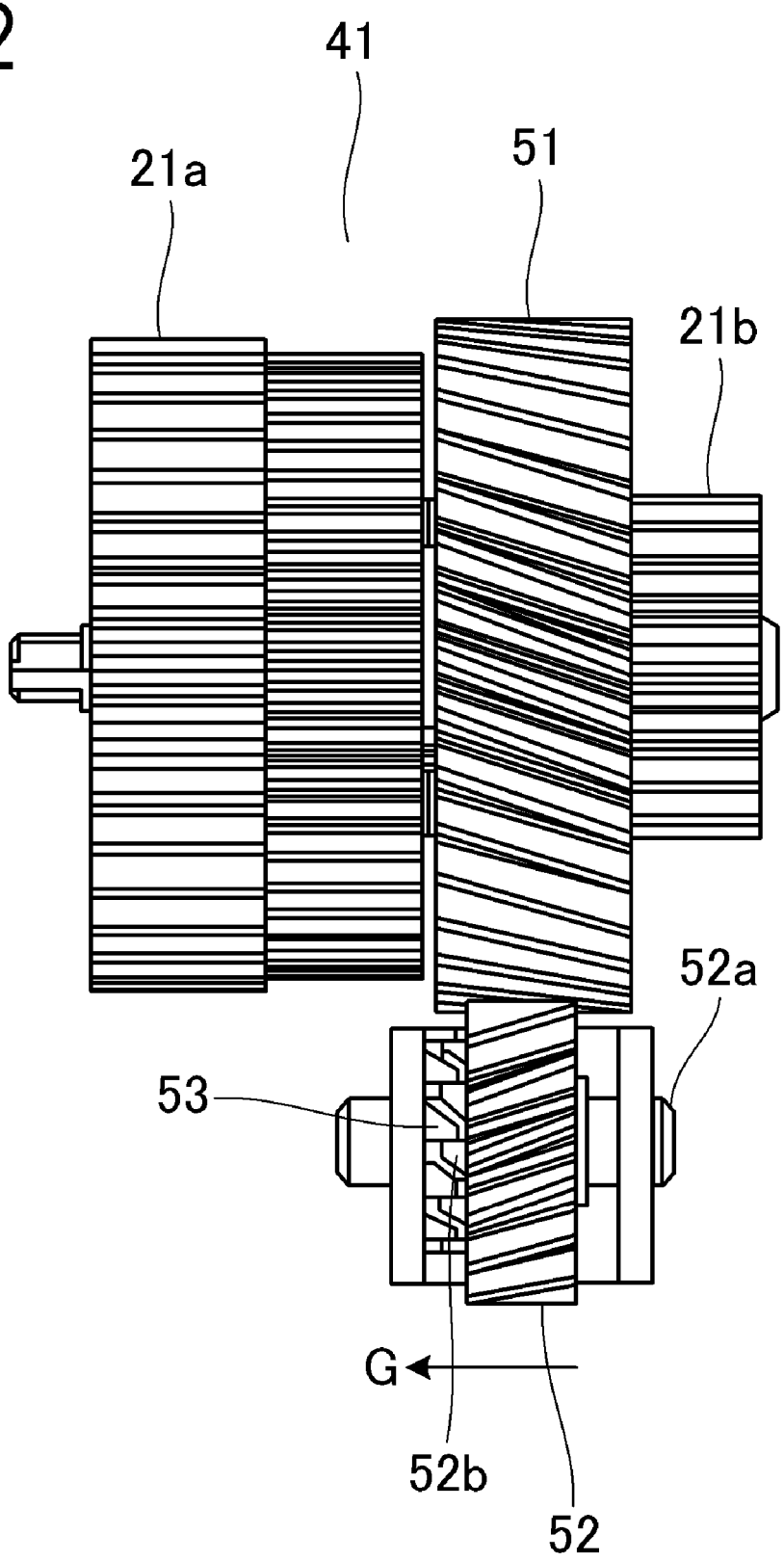
FIG. 22 is a side view of the important part of the driven gear according to Embodiment 2 of the present invention illustrating the second support position of the driven gear.

The engagement portion 53 is disposed so as to engage with the protruding portion 52*b* of the driven gear 52 to lock the driven gear 52 when the driven gear 52 is located at the second position, as depicted in FIG. 22. The protruding portion 33 is also disposed so as to lie away from the tooth flank 32*b* of the driven gear 52 when the driven gear 52 is located at the first support position and is rotating in conjunction with rotation of the drive gear 31. The engagement portions 53 are disposed so as to lie away from the protruding portions 52*b* of the driven gear 52 when the driven gear 32 rotates at the first support position in conjunction with rotation of the drive gear 51 as depicted in FIG. 20.

In other words, when the clutch gear 41 turns into the on state to allow the drive gear 51 to rotate forward, the driven gear 52 rotates in conjunction with the rotation of the drive gear 51 to permit the forward rotation of the drive gear 51. When the clutch gear 41 turns into the off state to displace the sheet stacking plate 14*a* in a lowering direction due to the weight of the sheet material S and the like, that is, to rotate the sheet stacking plate 14*a* in the direction in which the drive gear 51 rotates backward, rotation of the driven gear 52 is inhibited, thus preventing the drive gear 51 from rotating backward.

The above-described configuration eliminates the need for arrangement for complicated control such as engagement and separation of the pallet member with respect to the ratchet gear in conjunction with timings for separation and engagement of the switching member. The above-described configuration further eliminates the need for the ratchet gear itself, preventing the generation of noise resulting from collision and retraction of the pallet member with respect to the toothing of the ratchet gear. That is, Embodiment 2 can provide a configuration that enables possible noise to be prevented without the need for complicated control during operation of the mechanism that drives the sheet stacking plate 14*a* upward or keeps the sheet stacking plate 14*a* stopped, the configuration being different from the corresponding configuration in Embodiment 1.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-097231, filed on May 13, 2016, which is hereby incorporated by reference herein in its entirety.

What is claimed is:

1. A sheet stacking apparatus comprising:

a stacking plate on which a sheet material is stacked;

an elevating member that elevates the stacking plate;

a first rotating member that transmits, when rotating in a first direction, a force for elevating the stacking plate to the stacking plate;

a second rotating member that meshes with the first rotating member and rotates in conjunction with rotation of the first rotating member;

a support member that supports the second rotating member such that the second rotating member can move; and a locking member by which the second rotating member is enabled to be locked so as to stop rotation of the second rotating member, wherein the second rotating member is movable to a first support position and to a second support position on the support member, when the first rotating member rotates in the first direction, the second rotating member rotates at the first support position in conjunction with rotation of the first rotating member to permit the rotation of the first rotating member, when the first rotating member rotates in a second direction opposite to the first direction, the second rotating member moves to the second support position under a force received from the first rotating member in an area where the second rotating member meshes with the first rotating member, and at the second support position, the second rotating member is locked on the locking member, and the locked second rotating member prevents the first rotating member from rotating in the second direction, and the second rotating member moves to the first support position and to the second support position by moving relative to the support member in a direction of an axis of rotation.

2. The sheet stacking apparatus according to claim 1, wherein the support member has a support portion that supports the second rotating member such that the second rotating member can move in the direction of the axis of rotation, and the locking member has an engagement portion that contacts an end surface of the second rotating member to stop the second rotating member from rotating in conjunction with rotation of the first rotating member.

3. A sheet conveying apparatus comprising:

the sheet stacking apparatus according to claim 1; and a conveying means, contacting a sheet material stacked on the stacking plate elevated by the elevating member, for conveying the sheet material.

4. An image forming apparatus comprising:

the sheet conveying apparatus according to claim 3; and an image forming unit that forms an image on a sheet material conveyed by the sheet conveying apparatus.

5. A sheet stacking apparatus comprising:

a stacking plate on which a sheet material is stacked;

an elevating member that elevates the stacking plate;

a first rotating member rotatable in a first direction or a second direction which is opposite to the first direction;

a second rotating member rotatable in conjunction with rotation of the first rotating member;

a support member supports the second rotating member; and a locking member by which the second rotating member is enabled to be locked so as to stop rotation of the second rotating member, wherein the second rotating member is movable to a first support position and to a second support position on the support member, the support member has a guide member in which the second rotating member is supported so as to be movable in the circumferential direction around the axis of rotation of the first rotating member, in a case the first rotating member rotates in the first direction, the second rotating member rotates at the first support position in conjunction with rotation of the first rotating member to permit the rotation of the first rotating member, when the first rotating member rotates in the second direction, the second rotating member is moved from the first support position to the second support position by the guide member and the first support member, and the locking member has an engagement portion that engages with the second rotating member positioned at the second support position to stop rotation of the second member.

6. The sheet stacking apparatus according to claim 5, wherein the second rotating member moves to the first support position and to the second support position by moving relative to the support member.

7. The sheet stacking apparatus according to claim 5, wherein the guide member has a hole portion.

8. The sheet stacking apparatus according to claim 5, wherein the first rotating member is a multistage gear having at least a small-diameter gear and a large-diameter gear, and the small-diameter gear transmits a force to the elevating member while the large-diameter gear meshes with the second rotating member.

9. A sheet conveying apparatus comprising:

the sheet stacking apparatus according to claim 5; and a conveying means, contacting a sheet material stacked on the stacking plate elevated by the elevating member, for conveying the sheet material.

10. An image forming apparatus comprising:

the sheet conveying apparatus according to claim 9; and an image forming unit that forms an image on a sheet material conveyed by the sheet conveying apparatus.

* * * * *